US006090538A

United States Patent [19]

Arai et al.

[11] Patent Number: 6,090,538

[45] **Date of Patent: *Jul. 18, 2000**

[54] HEAT DEVELOPABLE LIGHT-SENSITIVE MATERIAL

[75] Inventors: Tsutomu Arai; Toshiaki Kubo; Minoru Sakai; Kohzaburoh Yamada; Kazunobu Katoh, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/698,081

[22] Filed: Aug. 15, 1996

[30] Foreign Application Priority Data

Aug. 15, 1995 [JP] Japan ..... 7-228627
Apr. 26, 1996 [JP] Japan ..... 8-107933

[51] Int. Cl.[7] ..... G03C 1/498

[52] U.S. Cl. ..... 430/619; 430/264; 430/617

[58] Field of Search ..... 430/617, 619, 430/203, 264

[56] References Cited

U.S. PATENT DOCUMENTS 3,152,904 10/1964 Sorensen et al. .
3,457,075 7/1969 Morgan et al. .
3,667,958 6/1972 Evans .
3,672,904 6/1972 de Mauriac .
3,782,949 1/1974 Olivares et al. .
5,001,032 3/1991 Katayama et al. ..... 430/619
5,262,295 11/1993 Tanaka et al. .
5,340,704 8/1994 Ezoe et al. ..... 430/264
5,496,645 3/1996 Simson et al. ..... 430/619
5,496,681 3/1996 Ezoe et al. ..... 430/264
5,496,695 3/1996 Simpson et al. .
5,677,121 10/1997 Tsuzuki .

FOREIGN PATENT DOCUMENTS

0741320A1 11/1996 European Pat. Off. .
WO 96/21174 7/1996 WIPO .

OTHER PUBLICATIONS

Thermally Processed Silver Systems, Imaging Processes and Materials, Neblette, 8th ed, compiled by Sturge, V. Walworth, p. 2, 1969.

*Primary Examiner*—Thorl Chea
*Attorney, Agent, or Firm*—Birch, Stewart, Kolasch & Birch, LLP

[57] ABSTRACT

A heat developable light-sensitive material comprising an organic acid silver and silver halide, which contains a compound represented by the following formula (A) and a hydrazine derivative:

(A)

wherein R represents a hydrogen atom or an alkyl group having from 1 to 10 carbon atoms and R' and R" each represents an alkyl group having from 1 to 5 carbon atoms.

14 Claims, No Drawings

HEAT DEVELOPABLE LIGHT-SENSITIVE MATERIAL

FIELD OF THE INVENTION

The present invention relates to a heat developable light-sensitive material. Particularly, the present invention relates to a heat developable light-sensitive material suitable for the photomechanical process.

BACKGROUND OF THE INVENTION

Heat developable light-sensitive materials forming a photographic image according to a heat developing method are disclosed in, for example, U.S. Pat. Nos. 3,152,904 and 3,457,075 and D. Morgan and B. Shely, "Thermally Processed Silver Systems" (Imaging Processes and Materials), Neblette, 8th ed., compiled by Sturge, V. Walworth and A. Shepp, page 2 (1969).

The heat developable light-sensitive material contains a silver source (e.g., organic silver salt) capable of reduction, a photocatalyst (e.g., silver halide) in an amount of catalytic activity, a color toner for controlling silver tone and a reducing agent, which are usually dispersed in a binder matrix. The heat developable light-sensitive material is stable at room temperature, however, when it is heated at a high temperature (e.g., 80° C. or higher) after exposure, silver is produced through an oxidation-reduction reaction between a silver source (which functions as an oxidizing agent) capable of reduction and a reducing agent. The oxidation-reduction reaction is accelerated by the catalytic action of a latent image generated upon exposure. Silver produced by the reaction of an organic silver salt in the exposure region provides a black image in contrast to the non-exposure region, thereby forming an image.

The above-described heat developable light-sensitive material has been used as a microphotographic light-sensitive material or for X-ray photographing. However, it is being used only partly as a light-sensitive material for printing. This is because the image obtained is low in Dmax and soft in gradation and the image quality is very bad as a light-sensitive material for printing.

On the other hand, recently, laser or light emission diode has been developed and scanner or image setter having an oscillation wavelength in the region of from 600 to 800 nm has been popularized. As a result, light-sensitive materials having adaptability to these output apparatuses and having high sensitivity, high Dmax and satisfactory contrast are being strongly demanded. Also, demands for simple processing and dry processing are increasing.

U.S. Pat. No. 3,667,958 describes a heat developable light-sensitive material using a polyhydroxybenzene and a hydroxylamine, a reductone or a hydrazine in combination and states that this material can show high image discriminability and high resolution. However, the combination with these reducing agents is found to readily cause increase of fogging.

SUMMARY OF THE INVENTION

An object of the present invention is to provide a heat developable light-sensitive material having high Dmax.

Another object of the present invention is to provide a light-sensitive material for photomechanical processing having good image quality.

Still another object of the present invention is to provide a light-sensitive material for photomechanical processing capable of dispensing with wet processing and of complete dry processing.

The above-described objects of the present invention can be attained by the following inventions 1)–5). 1) A heat developable light-sensitive material comprising an organic acid silver and silver halide, which contains a compound represented by the following formula (A) and a hydrazine derivative:

(A)

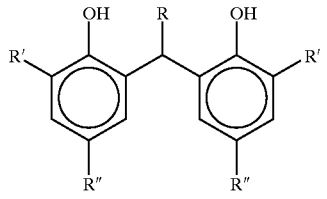

wherein R represents a hydrogen atom or an alkyl group having from 1 to 10 carbon atoms (e.g., —$C_4H_9$, 2,4,4-trimethylpentyl) and R' and R" each represents an alkyl group having from 1 to 5 carbon atoms (e.g., methyl, ethyl, t-butyl).

2) A heat developable light-sensitive material comprising an organic acid silver and silver halide, which contains a compound represented by formula (R-I), (R-II), (R-III) or (R-IV) and a hydrazine derivative:

(R-I)

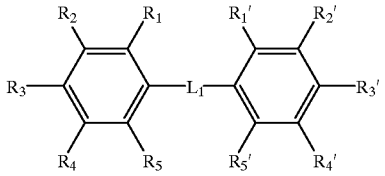

(R-II)

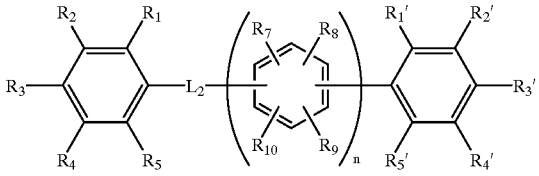

(R-III)

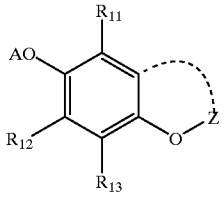

-continued (R-IV)

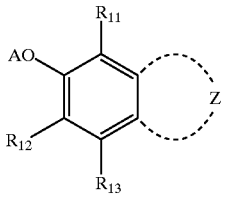

wherein in formula (R-III), the ring structure formed by Z is represented by the following formula (Z-1) or (Z-2):

(Z-1)

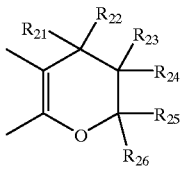

(Z-2)

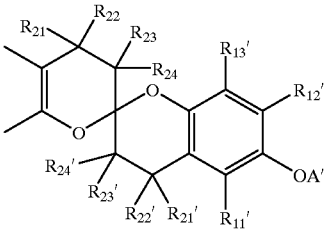

in formula (R-IV), the ring structure formed by Z is represented by the following formula (Z-3) or (Z-4):

(Z-3)

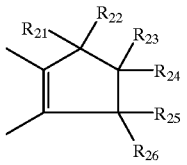

(Z-4)

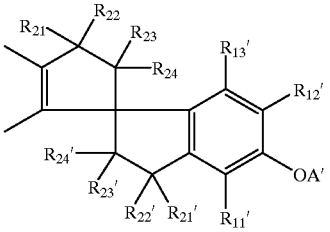

wherein $L_1$ and $L_2$ each represents a group represented by $>CH(R_6)$ or a sulfur atom, and n represents a natural number; in the formulae, $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$ each represents a hydrogen atom, an alkyl group, an aryl group, an aralkyl group, a halogen atom, an amino group or a group represented by —OA, provided that at least one of $R_1$ to $R_5$ is a group represented by —OA, at least one of $R_1'$ to $R_5'$ is a group represented by —OA, and at least one of $R_7$ to $R_{10}$ is a group represented by —OA, and a plurality of substituents in each cluster of $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$ may be combined with each other to form a ring;

A and A' each represents a hydrogen atom, an alkyl group, an acyl group, an aryl group, a phosphoric acid group or a sulfonyl group; and $R_1$ to $R_{10}$, $R_1'$ to $R_5'$, $R_{11}$ to $R_{13}$, $R_{11}'$ to $R_{13}'$, $R_{21}$ to $R_{26}$, $R_{21}'$ to $R_{24}'$, A and A' each may be substituted, provided that in formula (R-I), when at least one of $R_1$ to $R_5$ and at least one of $R_1'$ to $R_5'$ is a group represented by —OA, $L_1$ is a sulfur atom.

3) A heat developable light-sensitive material of 1) or 2), wherein said hydrazine derivative is represented by the following formula (I):

(I)

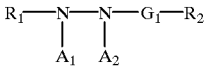

wherein $R_1$ represents an aliphatic group or an aromatic group, $R_2$ represents a hydrogen atom, an alkyl group, an aryl group, an unsaturated heterocyclic group, an alkoxy group, an aryloxy group, an amino group or a hydrazino group, and $G_1$ represents a —CO— group, an —$SO_2$— group or an -SO— group, a

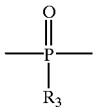

group, a —CO—CO— group, a thiocarbonyl group or an iminomethylene group, $A_1$ and $A_2$ both represent a hydrogen atom or one represents a hydrogen atom and the other represents a substituted or unsubstituted alkylsulfonyl group, a substituted or unsubstituted arylsulfonyl group or a substituted or unsubstituted acyl group, and $R_3$ represents a group selected from the same range as defined for $R_2$ and may be different from $R_2$.

4) A heat developable light-sensitive material of any one of 1) to 3), wherein said hydrazine derivative is a compound represented by the following formula (II), (III), (IV) or (V):

(II)

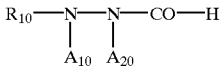

(III)

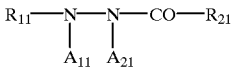

(IV)

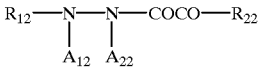

(V)

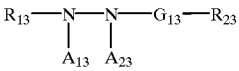

wherein $R_{10}$ to $R_{13}$ each represents an aromatic group or an unsaturated heterocyclic group, $A_{10}$ to $A_{13}$, $A_{20}$ to $A_{23}$ each has the same meaning as $A_1$ or $A_2$;

in formula (III), $R_{21}$ represents an alkyl group substituted by at least one electron-withdrawing group, an aryl group substituted by at least one electron-withdrawing group, a heterocyclic group, an amino group, an alkylamino group, an arylamino group, a heterocyclic amino group, a hydrazino group, an alkoxy group or an aryloxy group;

in formula (IV), $R_{22}$ represents an amino group, an alkylamino group, an arylamino group, a heterocyclic amino group, a hydrazino group, an alkoxy group, an aryloxy group, an alkyl group or an aryl group;

in formula (V), $G_{13}$ represents an —$SO_2$— group, an —SO— group, a

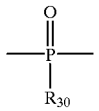

group (wherein $R_{30}$ has the same meaning as $R_3$ in $R_{30}$ formula (I)), a thiocarbonyl group or an iminomethylene group, and $R_{23}$ represents an alkyl group, an aryl group, an alkoxy group, an aryloxy group, an amino group, an alkylamino group, an arylamino group, a heterocyclic amino group or a hydrazino group.

5) A heat developable light-sensitive material of any one of 1) to 4), wherein the gradation γ after heat development satisfies γ>5.

DETAILED DESCRIPTION OF THE INVENTION

The hydrazine derivative for use in the present invention is preferably represented by the following formula (I):

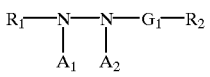

(I)

wherein $R_1$ represents an aliphatic group or an aromatic group; $R_2$ represents a hydrogen atom, an alkyl group, an aryl group, an unsaturated heterocyclic group, an alkoxy group, an aryloxy group, an amino group or a hydrazino group; $G_1$ represents a —CO— group, an —$SO_2$— group, an —SO— group, a

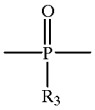

group, a —CO—CO— group, a thiocarbonyl group or an imino-methylene group; $A_1$ and $A_2$ both represent a hydrogen atom, or one represents a hydrogen atom and the other represents a substituted or unsubstituted alkylsulfonyl group, a substituted or unsubstituted arylsulfonyl group, or a substituted or unsubstituted acyl group, and $R_3$ is selected from the same groups defined for $R_2$ and may be different from $R_2$.

In formula (I), the aliphatic group represented by $R_1$ is preferably an aliphatic group having from 1 to 30 carbon atoms, more preferably a linear, branched or cyclic alkyl group having from 1 to 20 carbon atoms. The branched alkyl group may be cyclized to form a saturated heterocyclic ring containing therein one or more hetero atoms. The alkyl group may have a substituent.

In formula (I), the aromatic group represented by $R_1$ is a monocyclic or bicyclic aryl group or an unsaturated heterocyclic group. The unsaturated heterocyclic group may be ring-condensed with a monocyclic or bicyclic aryl group to form a heteroaryl group. Examples of the ring formed by $R_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. In particular, those containing a benzene ring are preferred. $R_1$ is particularly preferably an aryl group.

The aliphatic group or aromatic group represented by $R_1$ may be substituted with one or more substituents. Specific examples of the substituent include an alkyl group, an alkenyl group, an alkynyl group, an aryl group, a group containing a heterocyclic ring, a pyridinium group, a hydroxyl group, an alkoxy group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphoric acid amido group, a diacylamino group, an imido group, a group having an acylurea structure, a group containing a selenium atom or a tellurium atom, and a group having a tertiary sulfonium structure or a quaternary sulfonium structure. Preferred examples of the substituents include a linear, branched or cyclic alkyl group (preferably having from 1 to 20 carbon atoms), an aralkyl group (preferably monocyclic or bicyclic with the alkyl moiety having from 1 to 3 carbon atoms), an alkoxy group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms) and a phosphoric acid amido group (preferably having from 1 to 30 carbon atoms).

In formula (I), the alkyl group represented by $R_2$ is an alkyl group having from 1 to 4 carbon atoms, and the aryl group represented by $R_2$ is preferably a monocyclic or bicyclic aryl group, for example, one containing a benzene ring.

The unsaturated heterocyclic group represented by $R_2$ is a 5- or 6-membered ring compound containing at least one of a nitrogen atom, an oxygen atom and a sulfur atom. Examples thereof include an imidazolyl group, a pyrazolyl group, a triazolyl group, a tetrazolyl group, a pyridyl group, a pyridinium group, a quinolinium group and a quinolinyl group. A pyridyl group or a pyridinium group are particularly preferred.

The alkoxy group represented by $R_2$ is preferably an alkoxy group having from 1 to 8 carbon atoms, the aryloxy group represented by $R_2$ is preferably a monocyclic aryloxy group, and the amino group represented by $R_2$ is preferably an unsubstituted amino group, an alkylamino group having from 1 to 10 carbon atoms, or an arylamino group having from 6 to 20 carbon atoms.

$R_2$ may be substituted with one or more substituents and preferred substituents include those exemplified for the substituents of $R_1$.

When $G_1$ is a —CO— group, $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), an aryl group (e.g., phenyl, 3,5-dichlorophenyl, o-methanesulfonamidophenyl, 4-methanesulfonylphenyl, 2-hydroxymethylphenyl) or —$C_2F_4$COOM (M: a hydrogen atom or an alkali metal atom). Furthermore, when $G_1$ is an —$SO_2$— group, $R_2$ is preferably an alkyl group (e.g., methyl), an aralkyl group (e.g., o-hydroxybenzyl), an aryl group (e.g., phenyl) or a substituted amino group (e.g., dimethylamino).

When $G_1$ is a —COCO— group, $R_2$ is preferably an alkoxy group, an aryloxy group or an amino group.

In formula (I), $G_1$ is preferably a —CO— group or a —COCO— group, and most preferably a —CO— group.

$R_2$ may be a group which induces a cyclization reaction by cleaving the —$G_1$—$R_2$ moiety from the remaining molecule to form a cyclic structure containing atoms in the —$G_1$—$R_2$ moiety. Examples thereof include those described, for example, in JP-A-63-29751.

$A_1$ and $A_2$ are each a hydrogen atom, an alkylsulfonyl group having 1 to 20 carbon atoms, an arylsulfonyl group having from 6 to 20 carbon atoms (preferably, a phenylsulfonyl group or a phenylsulfonyl group substituted so that the sum of Hammett's substituent constants becomes −0.5 or more) or an acyl group having from 1 to 20 carbon atoms (preferably a benzoyl group, a benzoyl group substituted so that the sum of Hammett's substituent constants becomes −0.5 or more, or a linear, branched or cyclic, unsubstituted or substituted aliphatic acyl group (examples of the substituent includes a halogen atom, an ether group, a sulfonamido group, a carbonamido group, a hydroxyl group, a carboxyl group, a sulfone group)).

$A_1$ and $A_2$ are most preferably a hydrogen atom.

In formula (I), $R_1$ and $R_2$ each may be further substituted with a substituent and preferred examples of the substituent include those exemplified for the substituent of $R_1$.

In formula (I), $R_1$ or $R_2$ may be one having integrated thereinto a ballast group or a polymer commonly used in the immobile photographic additives such as a coupler. The ballast group is a group having 8 or more carbon atoms and relatively inactive to the photographic properties and examples thereof include an alkyl group, an aralkyl group, an alkoxy group, a phenyl group, an alkylphenyl group, a phenoxy group and an alkylphenoxy group. Examples of the polymer include those described, for example, in JP-A-1-100530.

In formula (I), $R_1$ or $R_2$ may be one having integrated thereinto a group capable of intensifying the adsorption onto the silver halide grain surface. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a heterocyclic thioamido group, a mercapto heterocyclic group and a triazole group.

The hydrazine derivative preferred in the present invention is a hydrazine derivative where $R_1$ is a phenyl group having a ballast group, a group which accelerates adsorption on the silver halide grain surface, a group having a quaternary ammonium structure or an alkylthio group through a sulfonamido group, an acylamino group or a ureido group; G is a —CO— group; and $R_2$ is a hydrogen atom, a substituted alkyl group or a substituted aryl group (the substituent is preferably an electron-withdrawing group or a hydroxymethyl group at the 2-position). With respect to the selected groups for each of $R_1$ and $R_2$, any combination may be freely used and preferred.

Among the hydrazine derivatives for use in the present invention, more preferred are compounds represented by formula (II), (III), (IV) or (V):

(II)

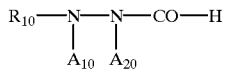

(III)

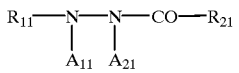

(IV)

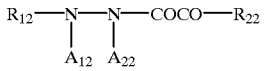

(V)

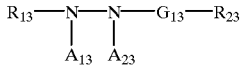

wherein $R_{10}$ to $R_{13}$ each represents an aromatic group or an unsaturated heterocyclic group, $A_{10}$ to $A_{13}$, $A_{20}$ to $A_{23}$ each has the same meaning as $A_1$ or $A_2$;

in formula (III), $R_2$, represents an alkyl group substituted by at least one electron-withdrawing group, an aryl group substituted by at least one electron-withdrawing group, a heterocyclic group, an amino group, an alkylamino group, an arylamino group, a heterocyclic amino group, a hydrazino group, an alkoxy group or an aryloxy group;

in formula (IV), $R_{22}$ represents an amino group, an alkylamino group, an arylamino group, a heterocyclic amino group, a hydrazine group, an alkoxy group, an aryloxy group, an alkyl group or an aryl group;

in formula (V), $G_{13}$ represents an —$SO_2$— group, an —SO— group, a

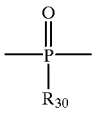

group (wherein $R_{30}$ has the same meaning as $R_3$ in formula (I)), a thiocarbonyl group or an iminomethylene group, and $R_{23}$ represents an alkyl group, an aryl group, an alkoxy group, an aryloxy group, an amino group, an alkylamino group, an arylamino group, a heterocyclic amino group or a hydrazino group.

Among the compounds represented by formula (II), more preferred are compounds represented by the following formula (II-1):

(II-1)

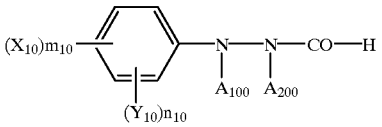

wherein $X_{10}$ represents a sulfonamido group, a ureido group, a thioureido group, an oxycarbonyl group, a sulfonamido group, a phosphonamido group, an alkylamino group, a halogen atom, a cyano group, an alkoxy group having a total carbon number of 2 or more, an aryloxy group, an alkylthio group, an arylthio group, a heterocyclic thio group, an acylamino group having a total carbon number of 3 or more, a carbamoyl group, a sulfamoyl group, an alkylsulfonyl group or an arylsulfonyl group, $m_{10}$ represents 0 or an integer of from 1 to 5, $Y_{10}$ represents a group represented by $X_{10}$, a nitro group, a methoxy group, an alkyl group or an acetamido group, $n_{10}$ represents 0 or an integer of from 1 to 4, provided that the sum of $m_{10}$ and $n_{10}$ does not exceed 10 and when $m_{10}$ is 0, one of $A_{100}$ and $A_{200}$ is not a hydrogen atom, $A_{100}$ and $A_{200}$ each has the same meaning as $A_1$ or $A_2$ in formula (I), and $m_{10}$ is preferably 1 or 2, $n_{10}$ is preferably 0 or 1, and most preferably, $m_{10}$ is 1 and $n_{10}$ is 0.

In formula (III), $R_{21}$ is preferably an alkyl group substituted by at least one electron-withdrawing group or an aryl group substituted by at least one electron-withdrawing group. The term "electron-withdrawing group" as used herein means a substituent having a Hammett's substituent constant $\sigma_m$ of a positive value and specific examples thereof include a halogen atom, a nitro group, a cyano group, an acyl group, an oxycarbonyl group, a sulfonamido group, a sulfamoyl group, a carbamoyl group, an acyloxy group, an alkylsulfonyl group, an arylsulfonyl group, an alkoxy group, an aryloxy group, an alkylthio group, an arylthio group or an imido group.

$R_{21}$ is more preferably an alkyl group substituted by at least one electron-withdrawing group and the electron-withdrawing group is particularly preferably a fluorine atom, an alkoxy group or an aryloxy group.

In formula (IV), $R_{22}$ is preferably an amino group, an alkylamino group, an arylamino group, a heterocyclic amino group or an alkoxy group.

In formula (V), $G_{13}$ is preferably an —$SO_2$— group, a thiocarbonyl group or a

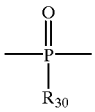

group (wherein $R_{30}$ has the same $R_{30}$ meaning as $R_3$ in formula (I)). $R_{23}$ is, when $G_{13}$ is an —$SO_2$— group, preferably an alkyl group or an aryl group, when $G_{13}$ is a

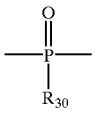

group, preferably an aryloxy group, an alkylamino group or an arylamino group, and when $G_{13}$ is a thiocarbonyl group, preferably an alkylamino group, an arylamino group or a hydrazino group.

Specific examples of the hyrdazine derivatives for use in the present invention are shown below.

I-1

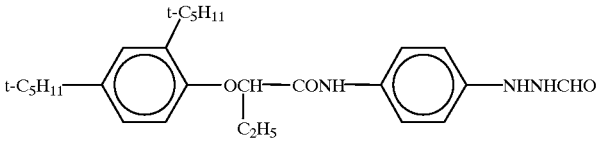

I-2

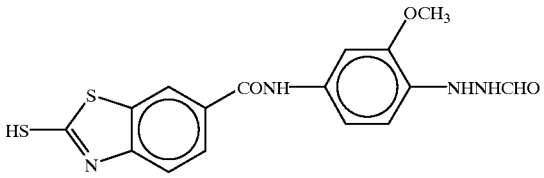

I-3

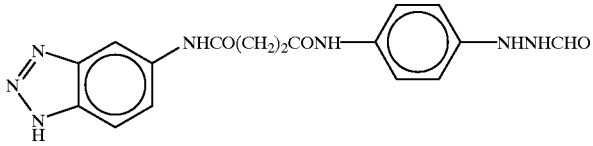

-continued
I-4
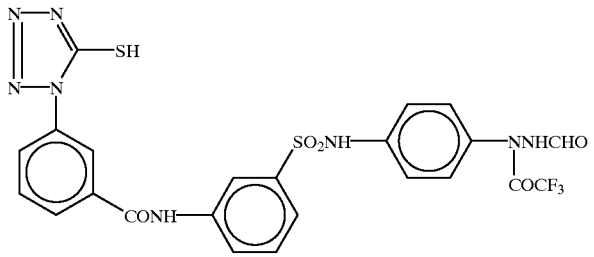
I-5
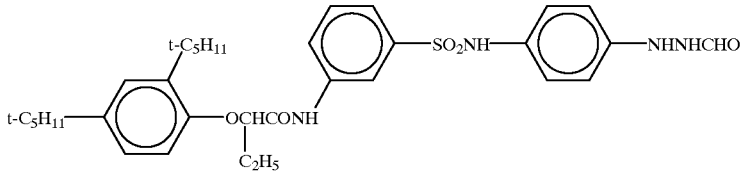
I-6
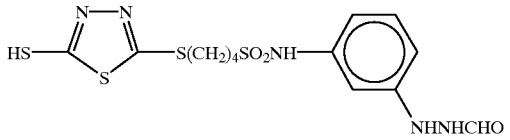
I-7
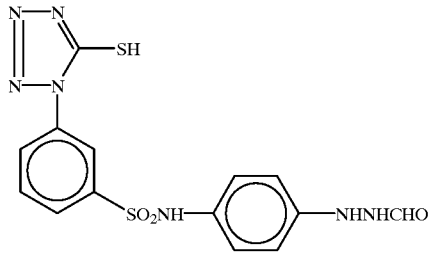
I-8
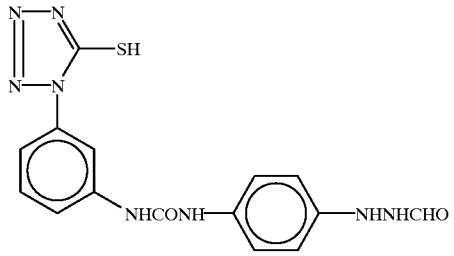
I-9
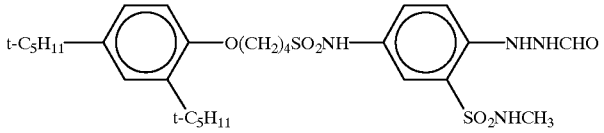
I-10
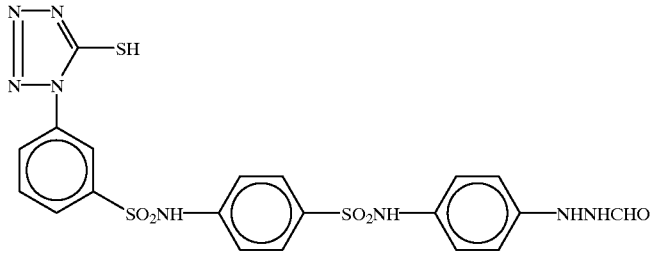

-continued
I-11
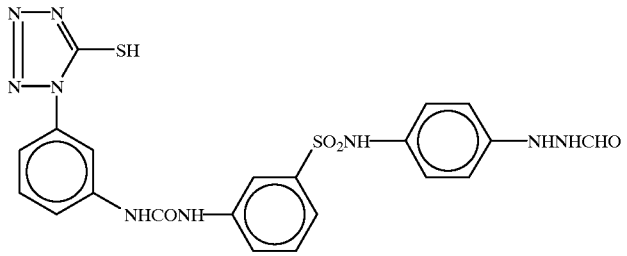
I-12
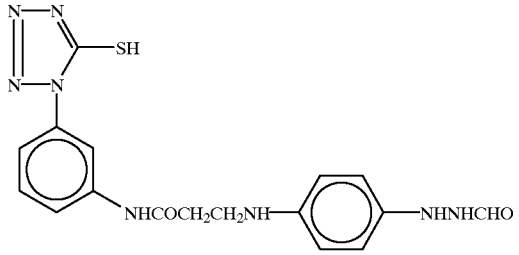
I-13
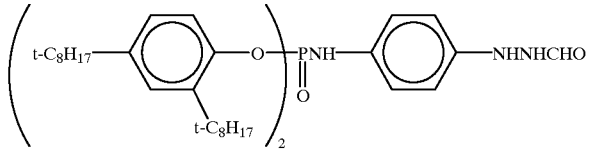
I-14
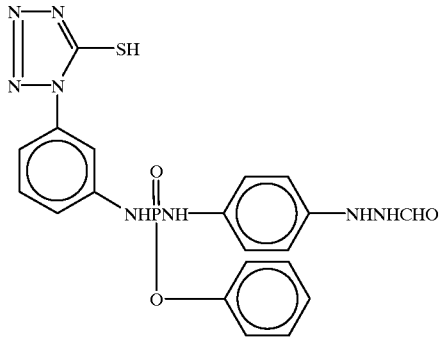
I-15
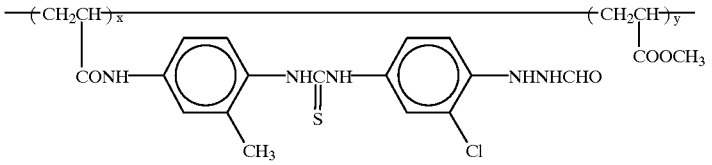
x:y = 3:97
Average molecular
weight = ca. 100,000
I-16
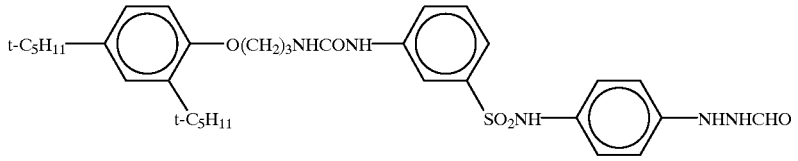

-continued
I-17
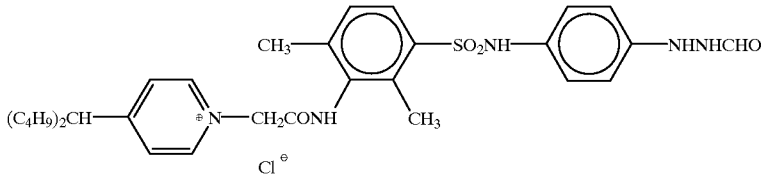
I-18
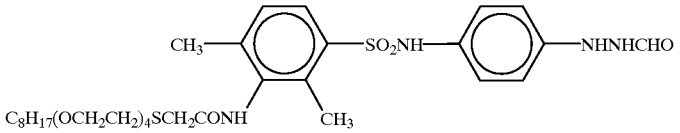
I-19
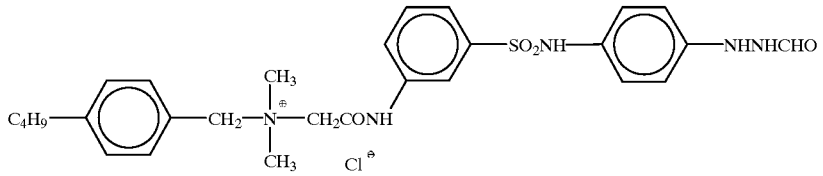
I-20
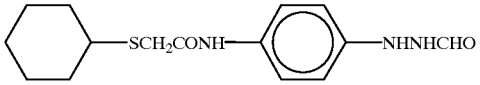
I-21
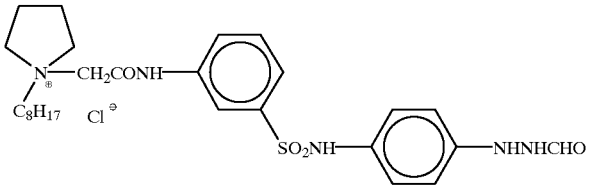
I-22
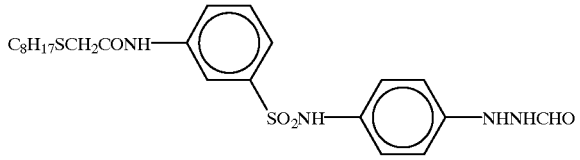
I-23
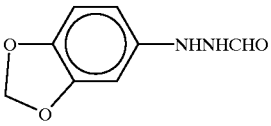
I-24
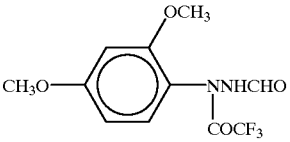
I-25
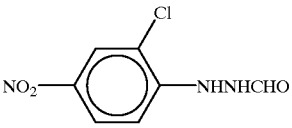

-continued
I-26
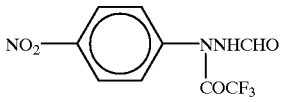
I-27
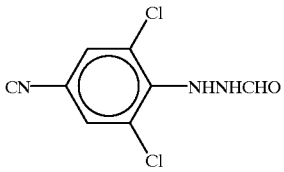
I-28
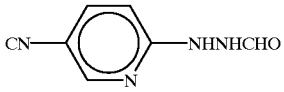
I-29
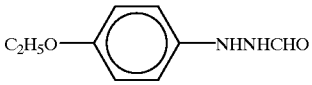
I-30
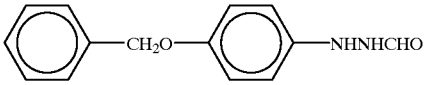
I-31
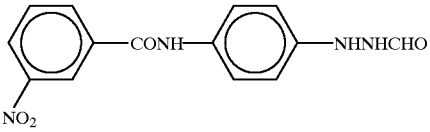
I-32
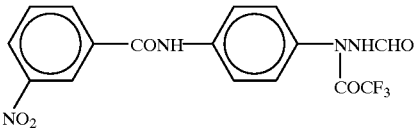
I-33
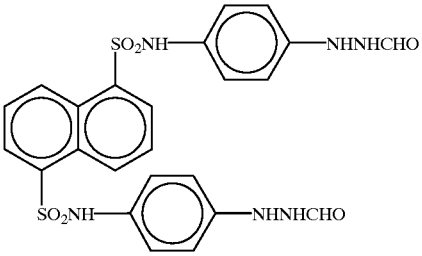
I-34
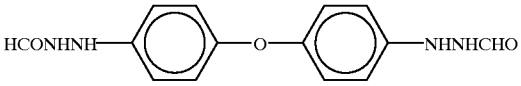
I-35
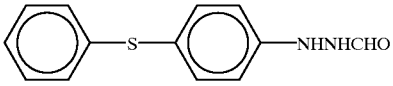
I-36
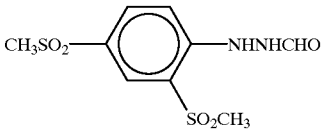

-continued
I-37
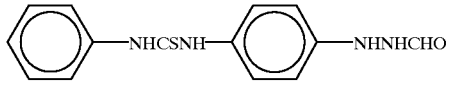
I-38
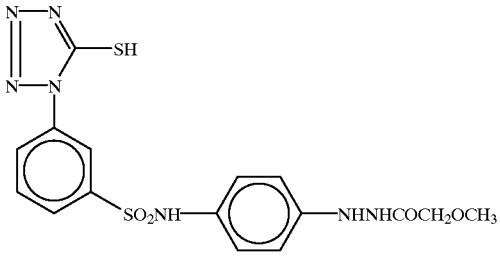
I-39
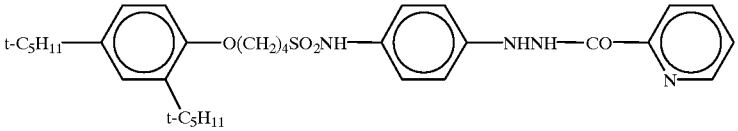
I-40
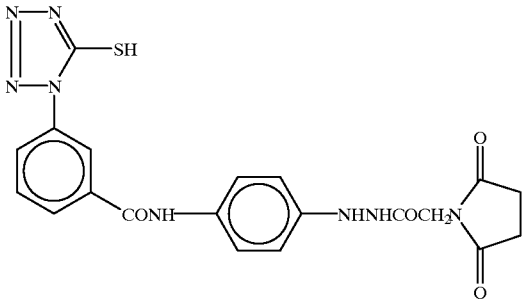
I-41
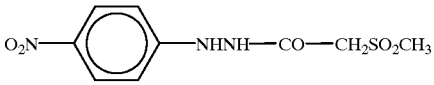
I-42
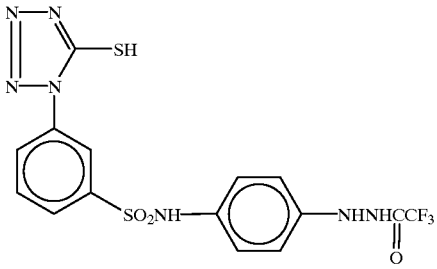
I-43
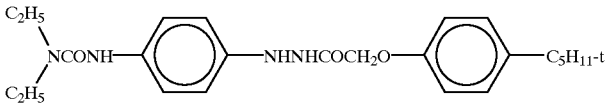
I-44
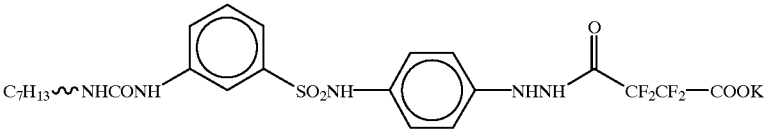

-continued
I-45
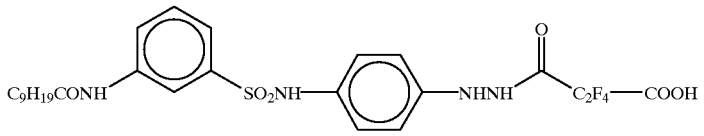
I-46
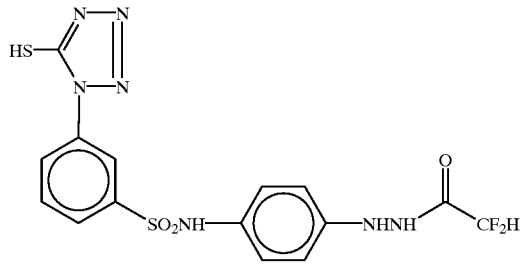
I-47
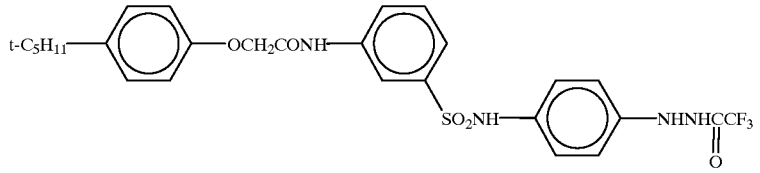
I-48
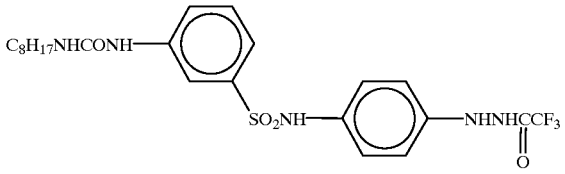
I-49
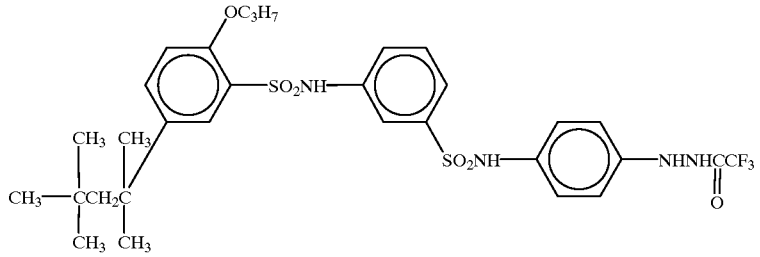
I-50
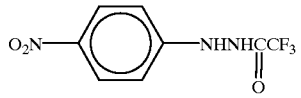
I-51
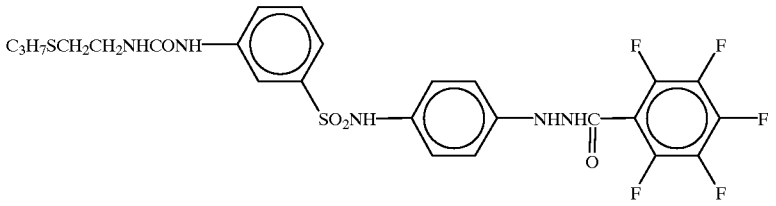
I-52
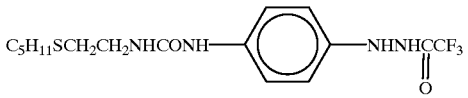

-continued
I-53
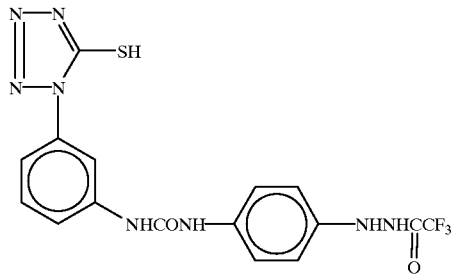
I-54
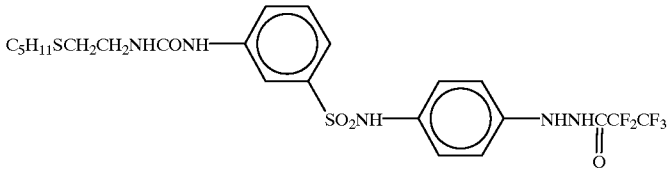
I-55
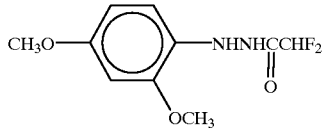
I-56
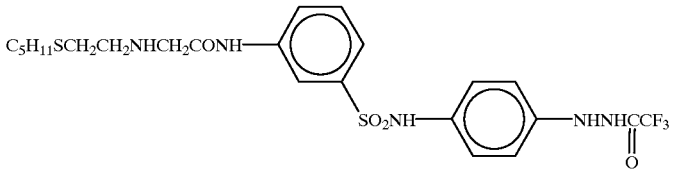
I-57
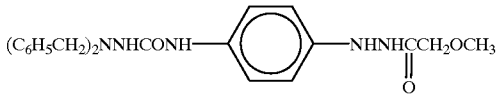
I-58
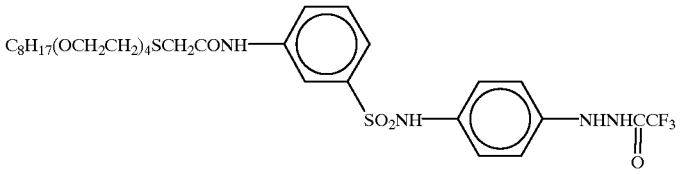
I-59
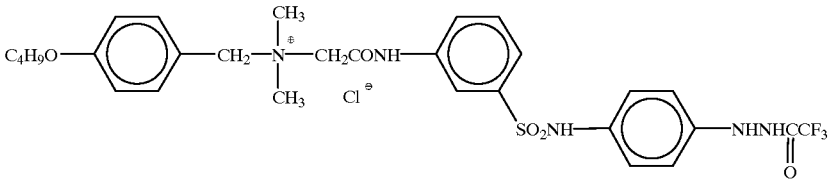
I-60
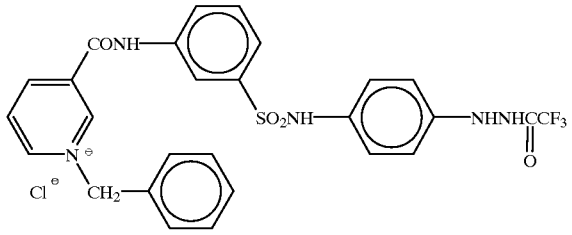

-continued
I-61
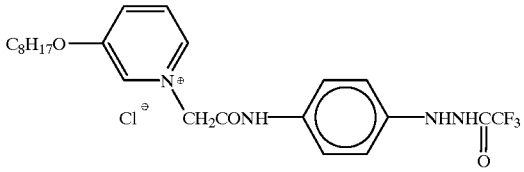
I-62
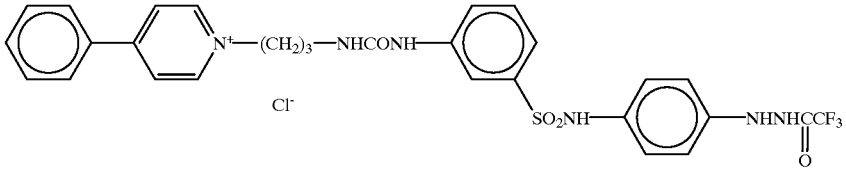
I-62'
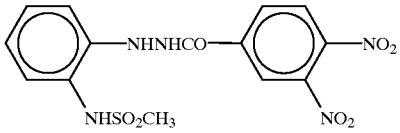
I-63
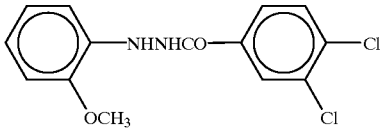
I-64
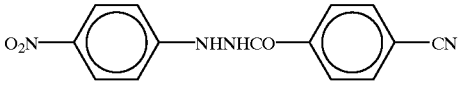
I-65
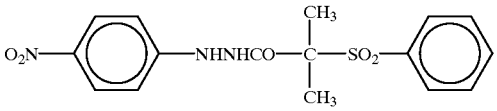
I-66
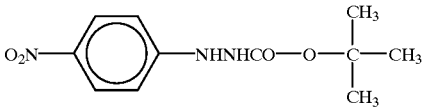
I-67
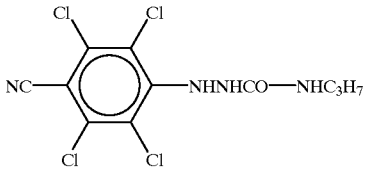
I-68
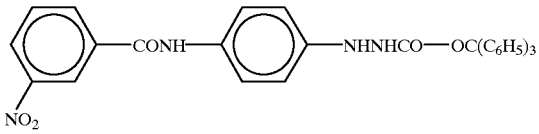
I-69
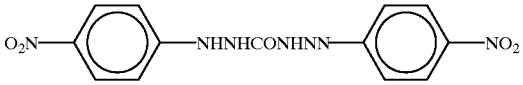

-continued
I-70
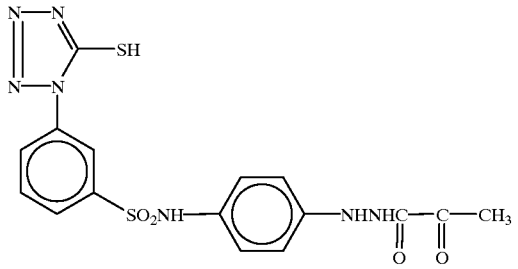
I-71
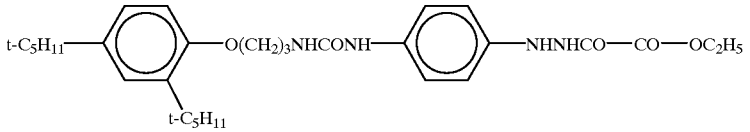
I-72
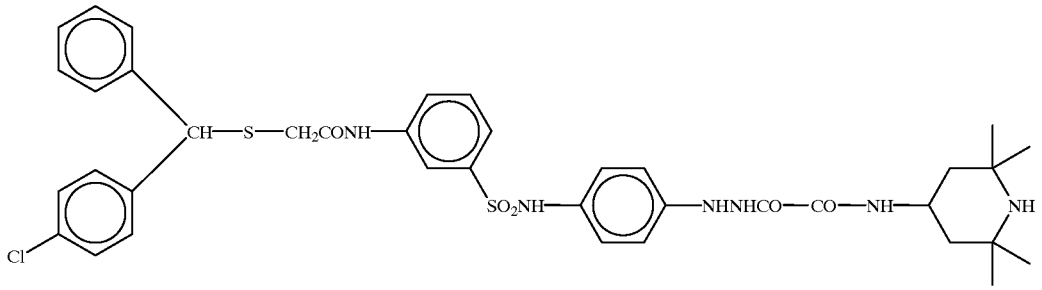
I-73
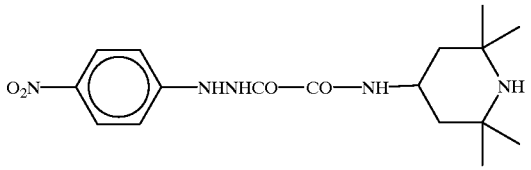
I-74
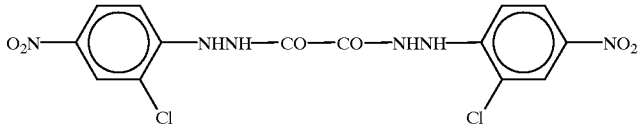
I-75
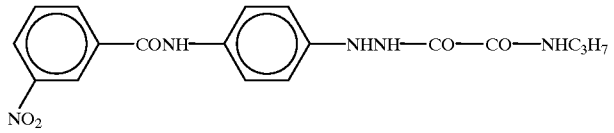
I-76
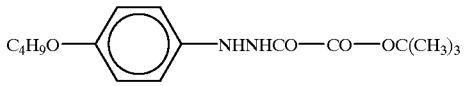
I-77
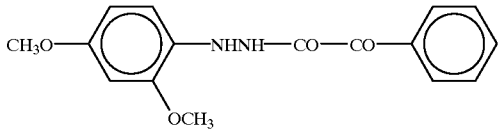
I-78
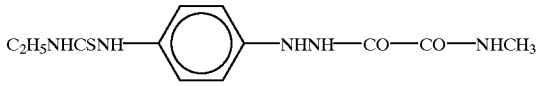

-continued

I-79

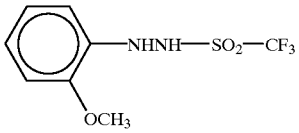

I-80

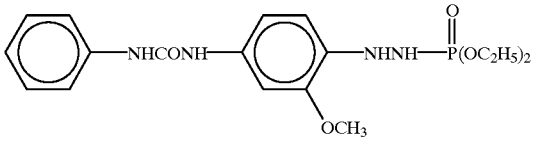

I-81

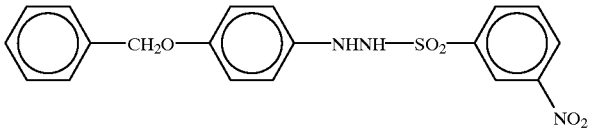

I-82

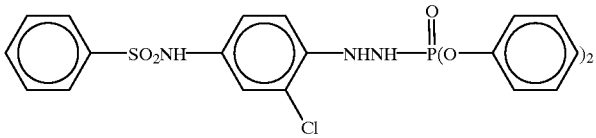

I-83

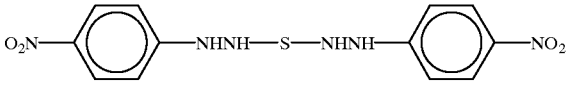

I-84

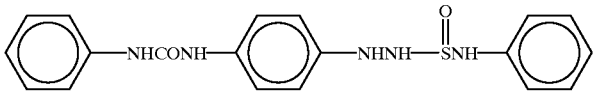

In addition to those described above, the hydrazine derivatives for use in the present invention include those described in *Research Disclosure*, Item 23516, p. 346 (November, 1983) and literatures cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent 2,011,391B, European Patents 217,310, 301,799 and 356,898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765 and JP-A-6-289524.

Further, in addition to those described above, examples thereof include the compound represented by (Chem. 1) of JP-B-6-77138, specifically, compounds described at pages 3 and 4 of the publication; the compound represented by formula (I) of JP-B-6-93082, specifically, Compounds 1 to 38 described at pages 8 to 18 of the publication; the compounds represented by formula (4), formula (5) or formula (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by formula (I) or formula (2) of JP-A-6-289520, specifically, Compounds 1-1) to 1-17) and 2-1) described at pages 5 to 7 of the publication; the compounds represented by (Chem. 2) or (Chem. 3) of JP-A-6-313936, specifically, compounds described at pages 6 to 19 of the publication; the compound represented by (Chem. 1) of JP-A-6-313951, specifically compounds described at pages 3 to 5 of the publication;, the compound represented by formula (I) of JP-A-7-5610, specifically, Compounds I-1 to I-38 described at pages 5 to 10 of the publication; the compound represented by formula (II) of JP-A-7-77783, specifically, Compounds II-1 to II-102 described at pages 10 to 27 of the publication; and the compounds represented by formula (H) or formula (Ha) of JP-A-7-104426, specifically, Compounds H-l to H-44 described at pages 8 to 15 of the publication.

The addition amount of the hydrazine derivative for use in the present invention is preferably from $1\times10^{-6}$ to $1\times10^{-1}$ mol/mol-Ag, more preferably from $1\times10^{-5}$ to $5\times10^{-2}$ mol/mol-Ag.

added in combination with the hydrazine derivative to the light-sensitive material.

Examples of the compound as a nucleation accelerator are set forth below.

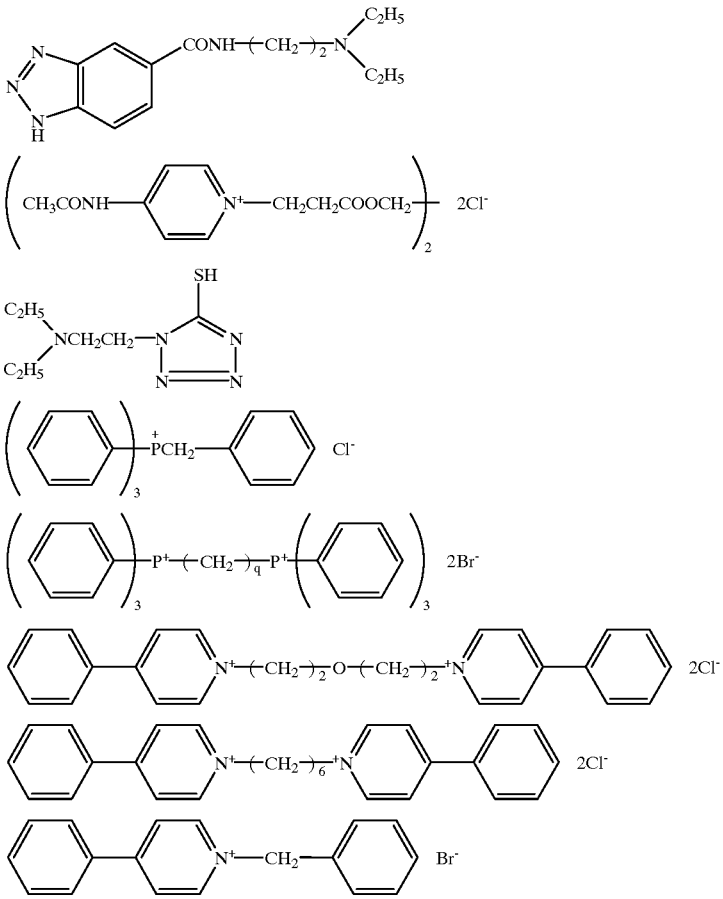

The hydrazine derivative for use in the present invention may be dissolved in an appropriate organic solvent before use, such as alcohols (e.g., methanol, ethanol, propanol, fluorinated alcohol), ketones (e.g., acetone, methyl ethyl ketone), dimethylformamide, dimethylsulfoxide and methyl cellosolve.

Further, the hydrazine derivative for use in the present invention may be dissolved by a well-known emulsion dispersion method using an oil such as dibutyl phthalate, tricresyl phosphate, glyceryl triacetate or diethyl phthalate, or an auxiliary solvent such as ethyl acetate or cyclohexanone, and an emulsion dispersion mechanically prepared and used. Or, the hydrazine derivative powder may be dispersed in water by means of ball mill, colloid mill or ultrasonic wave according to a method known as a solid dispersion method.

In the present invention, the hydrazine derivative for use in the present invention is preferably used in combination with an indazole (e.g., nitroindazole) as an antifoggant.

In the present invention, a nucleation accelerator such as an amine derivative, an onium salt compound, a disulfide derivative and a hydroxyamine derivative is preferably The addition amount of the nucleation accelerator for use in the present invention is preferably from $1\times10^{-6}$ to $2\times10^{-2}$ mol/mol-Ag, more preferably from $1\times10^{-5}$ to $2\times10^{-2}$ mol/mol-Ag, most preferably from $2\times10^{-5}$ to $1\times10^{-2}$ mol/mol-Ag.

According to one embodiment of the present invention, the heat developable light-sensitive material contains, as a reducing agent, the compound represented by the following formula (A):

(A)

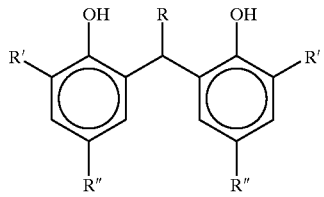

wherein R represents a hydrogen atom, an alkyl group having from 1 to 10 carbon atoms (e.g., —$C_4H_9$, 2,4,4-trimethylpentyl), and R' and R" each represents an alkyl group having from 1 to 5 carbon atoms (e.g., methyl, ethyl, t-butyl).

Specific examples of the compound represented by formula (A) are set forth below, but the present invention is by no means limited to these compounds.

A-1

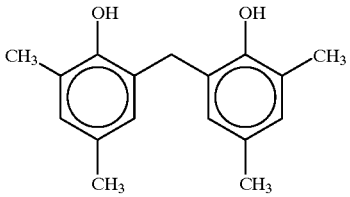

A-2

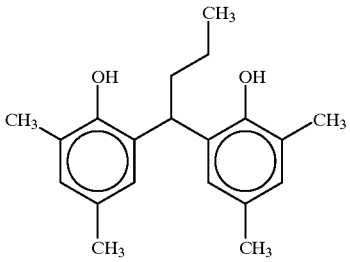

A-3

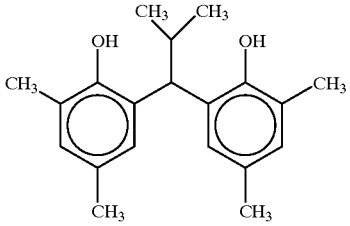

A-4

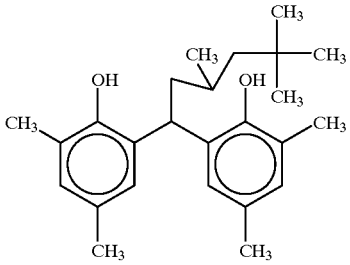

A-5

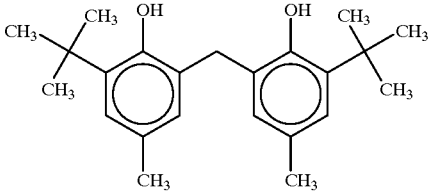

A-6

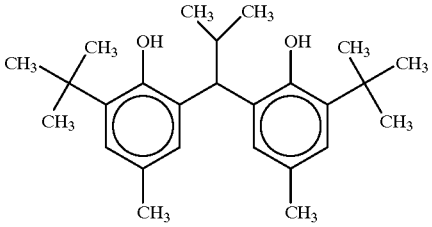

-continued

A-7

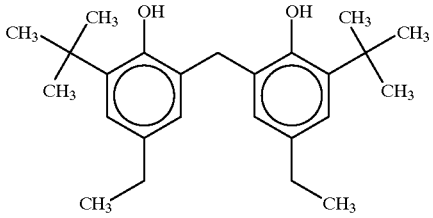

The use amount of the compound represented by formula (A) is preferably from $1\times10^{-2}$ mol/mol-Ag, more preferably from $1\times10^{-2}$ to 1.5 mol/mol-Ag.

According to one embodiment of the present invention, the heat developable light-sensitive material contains a compound represented by the following formula (R-I), (R-II), (R-III) or (R-IV) as a reducing agent:

(R-I)

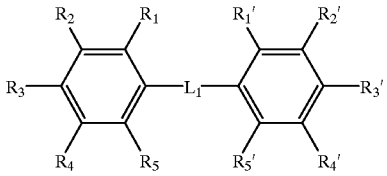

(R-II)

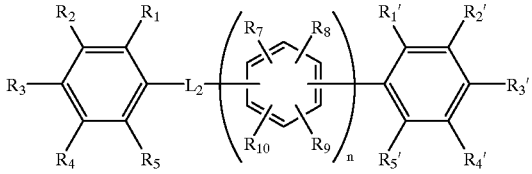

(R-III)

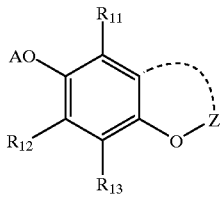

(R-IV)

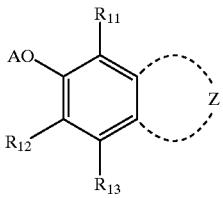

wherein in formula (R-III), the ring structure formed by Z is represented by the following formula (Z-1) or (Z-2):

(Z-1)

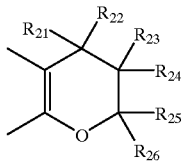

(Z-2)

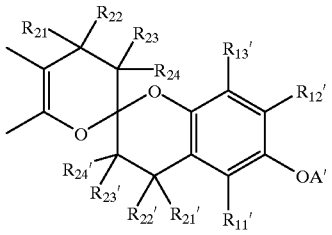

in formula (R-IV), the ring structure formed by Z is represented by the following formula (Z-3) or (Z-4):

(Z-3)

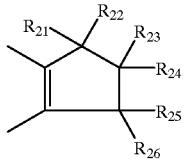

(Z-4)

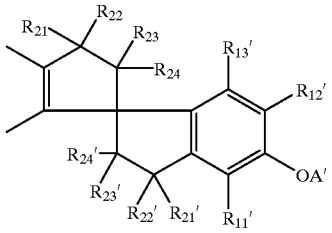

wherein $L_1$ and $L_2$ each represents a group represented by $>CH(R_6)$ or a sulfur atom, and n represents a natural number; in the formulae, $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$ each represents a hydrogen atom, an alkyl group, an aryl group, an aralkyl group, a halogen atom, an amino group or a group represented by —OA, provided that at least one of $R_1$ to $R_5$ is a group represented by —OA, at least one of $R_1'$ to $R_5'$ is a group represented by —OA, and at least one of $R_7$ to $R_{10}$ is a group represented by —OA, and a plurality of substituents in each cluster of $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$ may be combined with each other to form a ring;

A and A' each represents a hydrogen atom, an alkyl group, an acyl group, an aryl group, a phosphoric acid group or a sulfonyl group; and $R_1$ to $R_{10}$, $R_1'$ to $R_5'$, $R_{11}$ to $R_{13}$, $R_{11}'$ to $R_{13}'$, $R_{21}$ to $R_{26}$, $R_{21}'$ to $R_{24}'$, A and A' each may be substituted, provided that in formula (R-I), when at least one of $R_1$ to $R_5$ and at least one of $R_1'$ to $R_5'$ is a group represented by —OA, $L_1$ is a sulfur atom.

Examples of the substituent for $R_1$ to $R_{10}$, $R_1'$ to $R_5'$, $R_{11}$ to $R_{13}$, $R_{11}'$ to $R_{13}'$, $R_{21}$ to $R_{26}$, $R_{21}'$ to $R_{24}'$, A and A' include an alkyl group (including an active methylene group), a nitro group, an alkenyl group, an alkynyl group, an aryl group, a heterocyclic ring-containing group, a group containing a quaternized nitrogen atom-containing heterocyclic ring (e.g., pyridinio group), a hydroxy group, an alkoxy group (including a group containing an ethyleneoxy group or a propyleneoxy group as a repeating unit), an aryloxy group, an acyloxy group, an acyl group, an alkoxycarbonyl group, an aryloxycarbonyl group, a carbamoyl group, a urethane group, a carboxyl group, an imido group, an amino group, a carbonamido group, a sulfonamido group, a ureido group, a thioureido group, a sulfamoylamino group, a semicarbazido group, a thiosemicarbazido group, a hydrazino group-containing group, a quaternary ammonio group-containing group, a mercapto group, an alkylthio group, an arylthio group, a heterocyclic thio group, an alkylsulfonyl group, an arylsulfonyl group, an alkylsulfinyl group, an arylsulfinyl group, a sulfo group, an acyl group, a sulfamoyl group, an acylsulfamoyl group, an alkylsulfonylureido group, an arylsulfonylureido group, an alkylsulfonylcarbamoyl group, an arylsulfonylcarbamoyl group, a halogen atom, a cyano group, a phosphoric acid amide group, a group having a phosphoric acid ester structure, a group having an acylurea structure, a group containing a selenium atom or a tellurium atom, and a group having a tertiary sulfonium structure or a quaternary sulfonium structure. These substituents each may further be substituted and examples of the substituent to be further substituted include those described above.

Specific examples of the compounds represented by formulae (R-I), (R-II), (R-III) and (R-IV) are set forth below, however, the present invention is by no means limited thereto.

TABLE 1

| | (in formula (R-I)) | | | | | | |
|---|---|---|---|---|---|---|---|
| | $R_1,R_1'$ | $R_2,R_2'$ | $R_3,R_3'$ | $R_4,R_4'$ | $R_5,R_5'$ | $L_1$ | $R_6$ |
| R-I-1 | —OH | —$CH_3$ | —H | —$CH_3$ | —H | S | — |
| R-I-2 | —OH | —$CH_3$ | —H | —$C_2H_5$ | —H | S | — |
| R-I-3 | —OH | —$CH_3$ | —H | —$C_4H_9$(t) | —H | S | — |
| R-I-4 | —H | —$C_4H_9$(t) | —OH | —CPen | —H | —$CHR_6$ | —H |
| R-I-5 | —H | —$C_4H_9$(t) | —OH | —$C_4H_9$(t) | —H | —$CHR_6$ | —TMB |
| R-I-6 | —H | —$C_4H_9$(t) | —OH | —H | —H | —$CHR_6$ | —H |
| R-I-7 | —H | —$C_4H_9$(t) | —OH | —H | —H | —$CHR_6$ | —$C_3H_7$ |
| R-I-8 | —H | —$CH_3$ | —OH | —$C_4H_9$(t) | —H | —$CHR_6$ | —TMB |
| R-I-9 | —H | —$C_2H_5$ | —OH | —$C_4H_9$(t) | —H | —$CHR_6$ | —H |
| R-I-10 | —H | —$CH_3$ | —OH | —$C_2H_5$ | —H | —$CHR_6$ | —TMB |

TABLE 1-continued (in formula (R-I))

| | $R_1,R_1'$ | $R_2,R_2'$ | $R_3,R_3'$ | $R_4,R_4'$ | $R_5,R_5'$ | $L_1$ | $R_6$ |
|---|---|---|---|---|---|---|---|
| R-I-11 | —H | —$CH_3$ | —OH | —$CH_3$ | —H | S | — |
| R-I-12 | —H | —$CH_3$ | —OH | —$CH_3$ | —Cl | S | — |
| R-I-13 | —H | —$CH_3$ | —OH | —$C_2H_5$ | —Cl | S | — |
| R-I-14 | —H | —$C_2H_5$ | —OH | —$C_2H_5$ | —H | S | — |
| R-I-15 | —H | —$C_2H_5$ | —OH | —$CH_3$ | —Cl | S | — |
| R-I-16 | —H | —$CH_3$ | —OH | —$C_4H_9$(t) | —H | S | — |
| R-I-17 | —H | —CHex | —OH | —$C_4H_9$(t) | —H | S | — |

TMB: 1,3,3-trimethylbutyl group
CPen: cyclopentyl group
CHex: cyclohexyl group

TABLE 2

(in formula (R-I))

| No. | $R_1$ | $R_2$ | $R_3$ | $R_4$ | $R_5$ | $R_1'$ | $R_2'$ | $R_3'$ | $R_4'$ | $R_5'$ | $L_1$ | $R_6$ |
|---|---|---|---|---|---|---|---|---|---|---|---|---|
| R-I-18 | —OH | —$CH_3$ | —H | —$CH_3$ | —H | —H | —$CH_3$ | —OH | —$CH_3$ | —H | CH—$R_6$ | —H |
| R-I-19 | —OH | —$C_4H_9$(t) | —H | —$CH_3$ | —H | —H | —$CH_3$ | —OH | —$CH_3$ | —H | CH—$R_6$ | —H |
| R-I-20 | —OH | —$CH_3$ | —H | —$CH_3$ | —H | —H | —CHex | —OH | —$CH_3$ | —H | CH—$R_6$ | —$CH_3$ |
| R-I-21 | —OH | —$C_4H_9$(t) | —H | —$CH_3$ | —H | —H | —$CH_3$ | —OH | —$CH_3$ | —H | CH—$R_6$ | —$CH_3$ |
| R-I-22 | —OH | —$CH_3$ | —H | —$CH_2$ | —H | —H | —$CH_3$ | —OH | —$CH_3$ | —H | CH—$R_6$ | —TMB |
| R-I-23 | —OH | —$C_4H_9$(t) | —H | —$CH_3$ | —H | —H | —$CH_3$ | —OH | —$CH_3$ | —H | CH—$R_6$ | —TMB |
| R-I-24 | —OH | —$CH_3$ | —H | —$CH_3$ | —H | —H | —$CH_3$ | —OH | —$CH_3$ | —H | S | — |
| R-I-25 | —OH | —$C_4H_9$(t) | —H | —$CH_3$ | —H | —H | —$CH_3$ | —OH | —$CH_3$ | —H | S | — |
| R-I-26 | —OH | —$CH_3$ | —H | —$CH_3$ | —H | —H | —CHex | —OH | —$CH_3$ | —H | S | — |

TABLE 3

(in formula (R-II))

| No. | $R_1,R_1'$ | $R_2,R_2'$ | $R_3,R_3'$ | $R_4,R_4'$ | $R_5,R_5'$ | $R_7$ | $R_8$ | $R_9$ | $R_{10}$ | $L_1$ | $R_6$ | $L_2$ | $R_6'$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH—$R_6$ | —H | CH—$R_6'$ | —$CH_3$ | 1 |
| R-II-2 | —OH | —$CH_3$ | —H | —$CH_3$ | —H | —OH | —$C_2H_5$ | —$CH_3$ | —H | CH—$R_6$ | —TMB | CH—$R_6'$ | —$CH_3$ | 1 |
| R-II-3 | —OH | —$C_4H_9$(t) | —H | —$CH_3$ | —H | —OH | —$CH_3$ | —$CH_3$ | —H | CH—$R_6$ | —H | CH—$R_6'$ | —TMB | 3 |
| R-II-4 | —OH | —$CH_3$ | —H | —$CH_3$ | —H | —OH | —$C_2H_5$ | —$CH_3$ | —H | CH—$R_6$ | —TMB | CH—$R_6'$ | —TMB | 2 |
| R-II-5 | —H | —$C_4H_9$(t) | —OH | —$CH_3$ | —H | —OH | —$CH_3$ | —$CH_3$ | —H | S | — | CH—$R_6'$ | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$(t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH—$R_6'$ | —TMB | 3 |

TABLE 4

(in formula (R-III))

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_6H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

DHP: 2,4-dihydroxyphenyl group

TABLE 5

(in formula (R-III))

| No. | Z | $R_{11}$,$R_{11}$' | $R_{12}$,$R_{12}$' | $R_{13}$,$R_{13}$' | $R_{21}$,$R_{22}$ | $R_{21}$',$R_{22}$' | $R_{23}$,$R_{24}$ | $R_{23}$',$R_{24}$' | A,A' |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

TABLE 6

(in formula (R-IV))

| No. | Z | $R_{11}$ | $R_{12}$ | $R_{13}$ | $R_{21}$,$R_{22}$ | $R_{23}$,$R_{24}$ | $R_{25}$,$R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —H | —$CH_3$ | —H | —H |

TABLE 7

(in formula (R-IV))

| No. | Z | $R_{11}$,$R_{11}$' | $R_{12}$,$R_{12}$' | $R_{13}$,$R_{13}$' | $R_{21}$,$R_{21}$' | $R_{22}$,$R_{22}$' | $R_{23}$,$R_{24}$ | $R_{23}$',$R_{24}$' | A,A' |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |

R-I-27

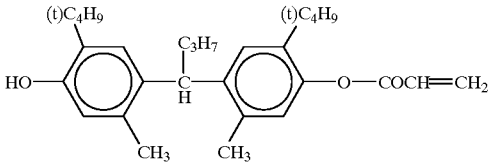

R-I-28

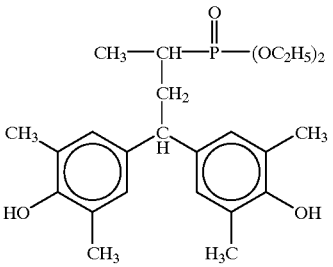

R-II-9

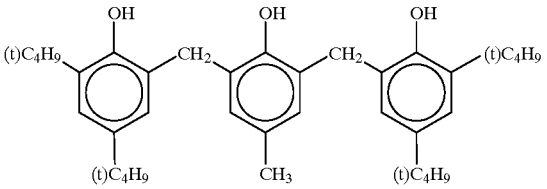

-continued

R-II-10

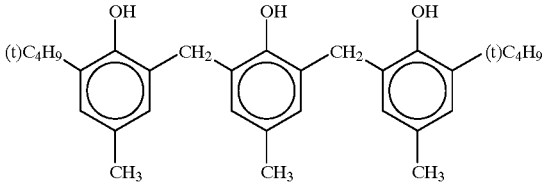

R-II-11

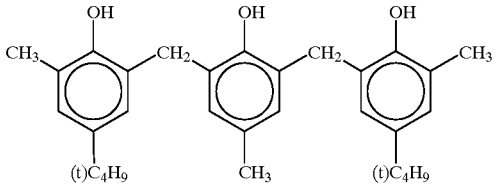

R-II-12

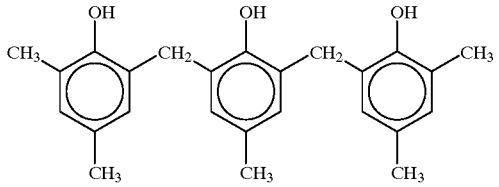

The use amount of the reducing agent represented by (R-I), (R-II), (R-III) or (R-IV) is preferably from $1\times10^{-3}$ to 10 mol/mol-Ag, more preferably from $1\times10^{-2}$ to 1.5 mol/mol-Ag.

The compounds represented by formula (A) and the compounds represented by formula (R-I), (R-II), (R-III) or (R-IV) may be used either individually or in combination. When they are used in combination, the sub-reducing agent is used in an amount of from 1/1,000 to 1/1 (by mol), preferably from 1/100 to 1/1 (by mol) to the main reducing agent.

The heat developable light-sensitive material of the present invention forms a photographic image using a heat developing method. The heat developable light-sensitive material is disclosed in, as described above, for example, U.S. Pat. Nos. 3,152,904 and 3,457,075 and D. Morgan and B. Shely, "Thermally Processed Silver Systems" (Imaging Processes and Materials), Neblette, 8th ed., compiled by Sturge, V. Walworth and A. Shepp, page 2 (1969).

The heat developable light-sensitive material of the present invention forms a photographic image using a heat developing method and preferably contains a silver source (e.g., organic silver salt) capable of reduction, a photocatalyst (e.g., silver halide) in an amount of catalytic activity, a color toner for controlling silver tone and a reducing agent in such a state that they are dispersed in a (organic) binder matrix. The heat developable light-sensitive material of the present invention is stable at room temperature, however, it is developed upon heating at a high temperature (e.g., 80° C. or higher) after exposure. By heating the light-sensitive material, an oxidation-reduction reaction is caused between a silver source (which functions as an oxidizing agent) capable of reduction and a reducing agent to produce silver. The oxidation-reduction reaction is accelerated by the catalytic action of a latent image generated upon exposure. Silver produced by the reaction of an organic silver salt in the exposure region provides a black image and makes a contrast to the non-exposure region, thereby forming an image.

The heat developable light-sensitive material of the present invention has at least one light-sensitive layer on a support. On the support, only light-sensitive layers may be formed, however, it is preferred to provide at least one light-insensitive layer on a light-sensitive layer.

In order to control the quantity of light transmitting through the light-sensitive layer or the wavelength distribution, a filter layer may be formed on the same side as or the opposite side to the light-sensitive layer, or a dye or pigment may be incorporated into the light-sensitive material. Preferred examples of the dye include compounds described in Japanese Patent Application No. 7-11184.

A plurality of light-sensitive layers may be provided or in order to control the gradation, the sensitivity may be arranged in the order of a high-sensitivity layer/a low-sensitivity layer or a low-sensitivity layer/a high-sensitivity layer.

Various additives may be added to any of light-sensitive layers, light-insensitive layers or other constituent layers.

In the heat developable light-sensitive material of the present invention, for example, a surface active agent, an antioxidant, a stabilizer, a plasticizer, an ultraviolet absorbent or a coating aid may be used.

The binder is suitably transparent or translucent and usually colorless. Examples thereof include natural polymer synthetic resins, polymers and copolymers, and other media capable of forming film such as gelatin, gum arabic, poly(vinyl alcohol), hydroxyethyl cellulose, cellulose acetate, cellulose acetate butylate, poly(vinyl pyrrolidone), casein, starch, poly(acrylate), poly(methyl methacrylate), poly(vinyl chloride), poly(methacrylate), copoly(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly(vinylidene chloride), poly(epoxide), poly(carbonate), poly(vinyl acetate), cellulose esters and poly(amide). The binder may be dissolved in water or an organic solvent and coated as an emulsion.

A color toner is very preferably added. Examples of suitable color toners are disclosed in *Research Disclosure*, No. 17029 and include: imides (e.g., phthalimide); cyclic imides, pyrazolin-5-ones and quinazolinone (e.g., succinimide, 3-phenyl-2-pyrazolin-5-one, 1-phenylurazole, quinazoline, 2,4-thiazolidinedione); naphthalimides (e.g., N-hydroxy-1,8-naphthalimide); cobalt complexes (e.g., hexaminetrifluoroacetate of cobalt), mercaptanes (e.g., 3-mercapto-1,2,4-triazole); N-(aminomethyl) aryldicarboxyimides (e.g., N-(dimethylaminomethyl) phthalimide); blocked pyrazoles, isothiuronium derivatives and combinations thereof with a certain kind of photobleaching agents (e.g., combination of N,N'-hexamethylene(1-carbamoyl-3,5-dimethylpyrazole), 1,8-(3,6-dioxaoctane)bis(isothiuroniumtrifluoroacetate) and 2-(tribromomethylsulfonyl)benzothiazole); merocyanine dyes (e.g., 3-ethyl-5-((3-ethyl-2-benzothiazolinylidene)-1-methylethylidene)-2-thio-2,4-oxazolidinedione)); phthalazinone, phthalazinone derivatives and metal salts of the derivative (e.g., 4-(1-naphthyl)phthalazinone, 6-chlorophthalazinone, 5,7-dimethyloxyphthalazinone, 2,3-dihydro-1,4-phthalazinedione); combinations of phthalazinone with a sulfinic acid derivative (e.g., 6-chlorophthalazinone+sodium benzenesulfinate or 8-methylphthalazinone+sodium p-trisulfonate); combinations of phthalazine+phthalic acid; combinations of phthalazine (including phthalazine adducts) with maleic anhydride and at least one compound selected from phthalic acid, 2,3-naphthalenedicarboxylic acid, o-phenylene acid derivative and an anhydride thereof (e.g., phthalic acid, 4-methylphthalic acid, 4-nitrophthalic acid, tetrachlorophthalic anhydride); quinazolinediones, benzoxazine and narthoxazine derivatives; benzoxazine-2,4-diones (e.g., 1,3-benzoxazine-2,4-dione); pyrimidines and asymmetric triazines (e.g., 2,4-dihydroxypyrimidine), and tetrazapentalene derivatives (e.g., 3,6-dimercapto-1,4-diphenyl-1H,4H-2,3a,5,6a-tetrazapentalene).

The color toner is preferably phthalazine.

The silver halide useful as a photocatalyst in an amount of catalytic activity may be any light-sensitive silver halide (e.g., silver bromide, silver iodide, silver chloride, silver chlorobromide, silver iodobromide, silver chloroiodobromide), but it preferably contains an iodine ion. The silver halide may be added to the image-forming layer by any method, however, the silver halide is disposed to be adjacent to the silver source capable of reduction. In general, the silver halide is preferably added in an amount of from 0.75 to 30 wt % based on the silver source capable of reduction. The silver halide may be prepared using conversion of the silver soap moiety upon reaction with a halogen ion or may be previously prepared and added at the time of generation of soap. These methods may also be used in combination. Preferred is the latter method.

The silver source capable of reduction is preferably a silver salt of an organic or heteroorganic acid containing a silver ion source capable of reduction, more preferably an aliphatic carboxylic acid having a long chain (having from 10 to 30, preferably from 15 to 25 carbon atoms). Organic or inorganic silver salt complexes having an overall stability constant of the ligand to the silver ion of from 4.0 to 10.0 are also useful. Examples of suitable silver salts are described in *Research Disclosure*, No. 17029 and No. 29963 and include: salts of an organic acid (e.g., gallic acid, oxalic acid, behenic acid, stearic acid, palmitic acid, lauric acid); carboxyalkylthiourea salts of silver (e.g., 1-(3-carboxypropyl)thiourea, 1-(3-carboxypropyl)-3,3-dimethylthiourea); silver complexes as a polymer reaction product of aldehyde with a hydroxy-substituted aromatic carboxylic acid (for example, aldehydes (e.g., formaldehyde, acetaldehyde, butylaldehyde), hydroxy-substituted acids (e.g., salicylic acid, benzoic acid, 3,5-dihydroxybenzoic acid, 5,5-thiodisalicylic acid), silver salts and complexes of thioenes (e.g., 3-(2-carboxyethyl)-4-hydroxymethyl-4-thiazoline-2-thioene, 3-carboxymethyl-4-thiazoline-2-thioene), and complexes and salts of silver with a nitrogen acid selected from imidazole, pyrazole, urazol, 1,2,4-thiazole, 1H-tetrazole, 3-amino-5-benzylthio-1,2,4-triazole and benzotriazole); silver salts of saccharine or 5-chlorosalicylaldoxime; and silver salts of mercaptides. The silver source is preferably silver behenate. The silver source capable of reduction is used in an amount of, in terms of silver, preferably 3 g/m$^2$ or less, more preferably 2 g/m$^2$ or less.

The light-sensitive material may contain an antifoggant. The most effective antifoggant has been a mercury ion. The use of a mercury compound as an antifoggant in the light-sensitive material is disclosed in, for example, U.S. Pat. No. 3,589,903. However, the mercury compound is not preferred in view of environmental issue. As the non-mercury antifoggant, antifoggants disclosed in U.S. Pat. Nos. 4,546,075 and 4,452,885 and JP-A-59-57234 are preferably used.

More preferred examples of the non-mercury antifoggant include compounds disclosed in U.S. Pat. Nos. 3,874,946 and 4,756,999, specifically, the heterocyclic compound having one or more substituents represented by the formula: —C($X^1$)($X^2$)($X^3$) (wherein $X^1$ and $X^2$ each represents a halogen (e.g., F, Cl, Br, I) and $X^3$ represents hydrogen or halogen). Examples of suitable antifoggants include the following compounds:

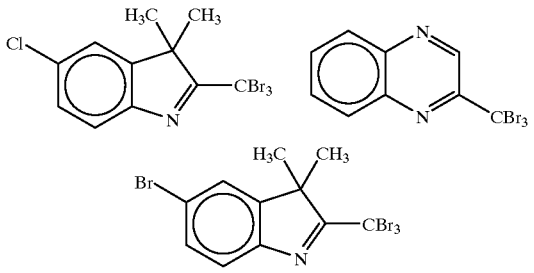

-continued

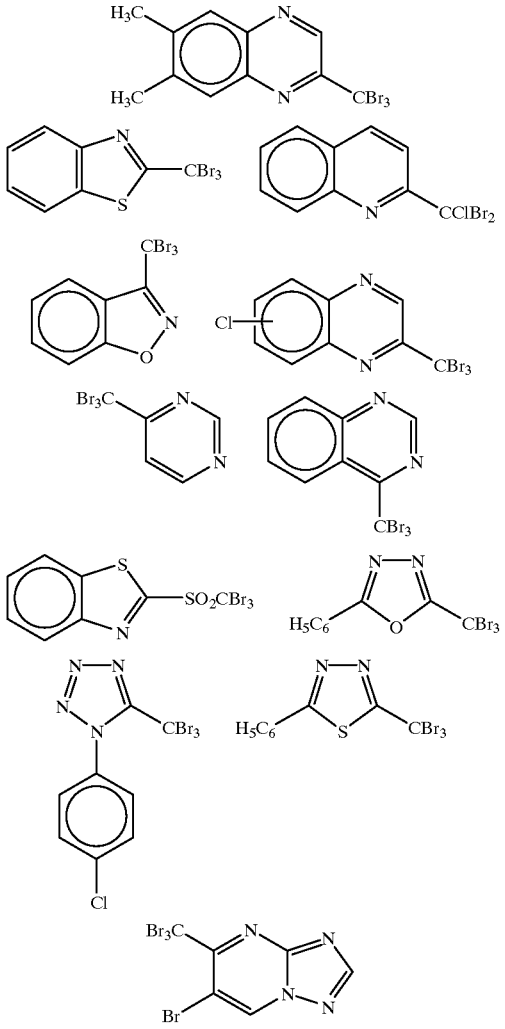

Examples of more suitable antifoggants are disclosed in U.S. Pat. No. 5,028,523 and British Patent Application Nos. 92221383.4, 9300147.7 and 9311790.1.

In the heat developable light-sensitive material of the present invention, sensitizing dyes described in, for example, JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175 and 4,835,096 may be used.

Examples of useful sensitizing dyes for use in the present invention are described in *Research Disclosure*, Item 17643 IV-A, page 23 (December, 1978), and ibid., Item 1831X, page 437 (August, 1978).

In particular, sensitizing dyes having spectral sensitivity suitable for spectral characteristics of various scanner light sources may be advantageously selected.

For example,

A) for an argon laser light source, simple merocyanines described in JP-A-60-162247, JP-A-2-48653, U.S. Pat. No. 2,161,331, West German Patent 936,071 and JP-A-5-11389;

B) for a helium-neon laser light source, trinuclear cyanine dyes described in JP-A-50-62425, JP-A-54-18726 and JP-A-59-102229 and merocyanines described in JP-A-7-287338;

C) for an LED light source or a red semiconductor laser, thiacarbocyanines described in JP-B-48-42172, JP-B-51-9609, JP-B-55-39818, JP-A-62-284343 and JP-A-2-105135; and D) for an infrared semiconductor laser light source, tricarbocyanines described in JP-A-59-191032 and JP-A-60-80841, and dicarbocyanines containing a 4-quinoline nucleus represented by formula (IIIa) or formula (IIIb) of JP-A-3-67242 and JP-A-59-192242, may be advantageously selected.

These sensitizing dyes may be used individually or in combination thereof, and the combination of sensitizing dyes is often used for the purpose of supersensitization. Together with the sensitizing dye, a dye which itself has no spectral sensitization action or a substance which absorbs substantially no visible light, but which exhibits supersensitization, may be incorporated into the emulsion.

The heat developable light-sensitive material of the present invention is exposed preferably to an Ar laser (488 nm), a He—Ne laser (633 nm), a red semiconductor layer (670 nm) or an infrared semiconductor layer (780 nm, 830 nm).

The heat developable light-sensitive material of the present invention may have a dye-containing layer as an antihalation layer. In the case of exposure to an Ar laser, a He—Ne laser or a red semiconductor laser, a dye showing absorption of at least 0.3 or more, preferably 0.8 or more at the exposure wavelength in the range of from 400 to 750 nm is added. In the case of exposure to an infrared semiconductor layer, a dye showing an absorption of at least 0.3 or more, preferably 0.8 or more at the exposure wavelength in the range of from 750 to 1,500 nm is added. A sole dye may be used or a plurality of dyes may be used in combination.

The dye may be added to a dye layer closer to the support on the same side as the light-sensitive layer or may be added to a dye layer on the opposite side to the light-sensitive layer.

The support for use in the present invention may be paper, synthetic paper, paper laminated with a synthetic resin (e.g., polyethylene, polypropylene, polystyrene), plastic film (e.g., polyethylene terephthalate, polycarbonate, polyimide, nylon, cellulose triacetate), a metal plate (e.g., aluminum, aluminum alloy, zinc, iron, copper), or paper or plastic film laminated or evaporated with the above-described metal.

The plastic film is stretched or shrinks in the film dimension upon passing through a heat developing machine. When the heat developable light-sensitive material is used as a printing light-sensitive material and precision multicolor printing is performed, this stretching/shrinking causes a serious problem. Accordingly, the film for use in the present invention is preferably reduced in the dimensional change. Examples of the film include a styrene-base polymer having a syndiotactic structure or a heat-treated polyethylene. Those having a high glass transition point are also preferably used and polyether ethyl ketone, polystyrene, polysulfone, polyether sulfone or polyarylate may be used.

The present invention is described in greater detail below with reference to the Examples, however, the present invention should not be construed as being limited thereto.

EXAMPLE 1

| Preparation of Light-Sensitive Emulsion A: | |
|---|---|
| Solution (1) | |
| Stearic acid | 131 g |
| Behenic acid | 635 g |
| Distilled water | 13 l |
| Mixed at 90° C. for 15 minutes. | |
| Solution (2) | |
| NaOH | 89 g |
| Distilled water | 1.5 l |
| Solution (3) | |
| Concentrated $HNO_3$ | 19 ml |
| Distilled water | 50 ml |
| Solution (4) | |
| $AgNO_3$ | 365 g |
| Distilled water | 2.5 l |
| Solution (5) | |
| Polyvinyl butyral | 86 g |
| Ethyl acetate | 4.3 l |
| Solution (6) | |
| Polyvinyl butyral | 290 g |
| Isopropanol | 3.6 l |
| Solution (7) | |
| N-Bromosuccinimide | 9.7 g |
| Acetone | 690 ml |

To Solution (1) kept at a temperature of 90° C., Solution (2) was added while vigorously stirring over 5 minutes and then Solution (3) was added over 25 minutes. The stirring was continued for 20 minutes and then the temperature was lowered to 35° C. Solution (4) was added while vigorously stirring at 35° C. over 5 minutes and the stirring continued for 90 minutes. Thereafter, Solution (5) was added, the stirring was stopped to allow the mixture to stand, the aqueous layer was removed together with salts contained therein to obtain an oil phase, the solvent was removed, the remaining water was eliminated, Solution (6) was added, the mixture was vigorously stirred at 50° C., Solution (7) was added over 20 minutes, and the stirring was performed for 105 minutes to obtain Emulsion A.

On a heat-treated polyethylene terephthalate support, respective layers described below were formed in sequence to prepare a sample. The drying was performed each time at 75° C. for 5 minutes.

Coating on Back Surface Side:

The solution having the following composition was coated to have a wet thickness of 80 $\mu$m.

| | |
|---|---|
| Polyvinyl butyral (10% isopropanol solution) | 150 ml |
| Dye-B | 70 mg |
| Dye-C | 70 mg |

Dye-B

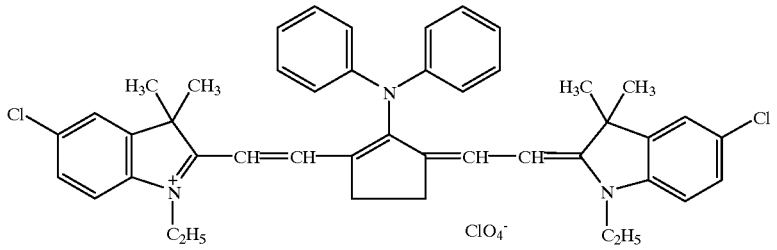

Dye-C

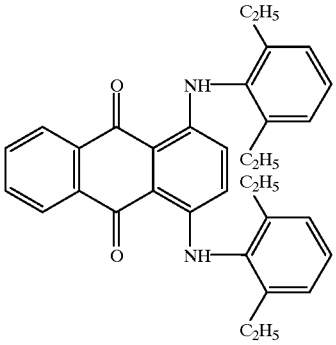

Coating on Light-Sensitive Surface Side:

Light-Sensitive Layer 1:

The solution having the following composition was coated to have a wet thickness of 140 $\mu$m.

| | |
|---|---|
| Light-Sensitive Emulsion A | 73 g |
| Sensitizing dye-1 (0.1% DMF solution) | 2 ml |
| Antifoggant-1 (0.01% methanol solution) | 3 ml |
| Antifoggant-2 (0.85% methanol solution) | 10 ml |
| Antifoggant-3 (0.85% methanol solution) | 10 ml |
| Phthalazone (4.5% DMF solution) | 8 ml |
| Developer-1 (10% acetone solution) | 13 ml |
| Nucleation Accelerator-1 (1% methanol solution) | 1 ml |
| Antifoggant-4 (1% methanol solution) | 2 ml |
| Hydrazine derivative (1% methanol/DMF 4:1 solution; the kind is shown in Table 8) | 2 mg |

Sensitizing Dye 1

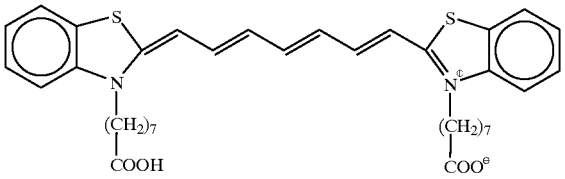

Antifoggant-1

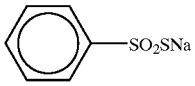

Antifoggant-2 (compound described in U.S. Pat. No. 3,785,946)

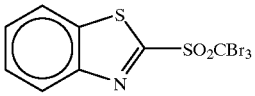

Antifoggant-3 (compound described in EP 605981)

-continued
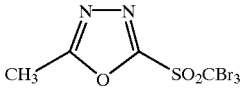
Developer-1
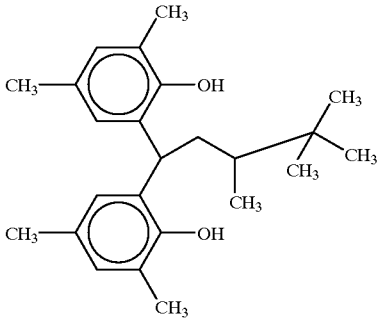
Nucleation Accelerator-1
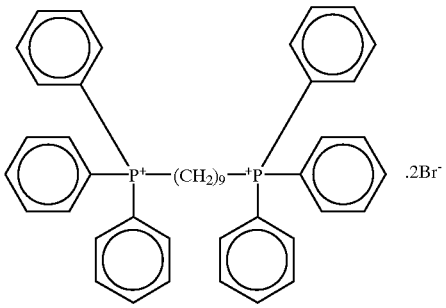
Antifoggant-4
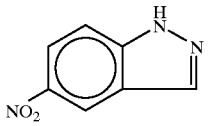
Hydrazine Derivative H-1
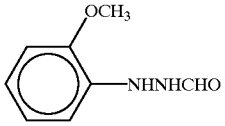
Hydrazine Derivative H-2
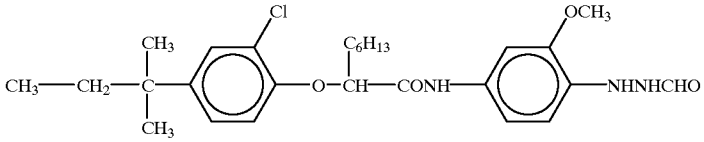
Hydrazine Derivative H-3
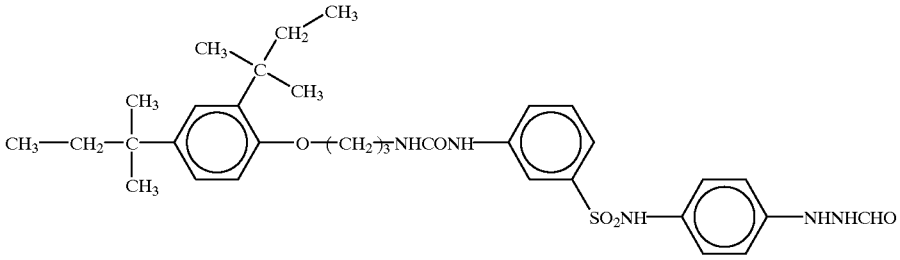
Hydrazine Derivative H-4

-continued

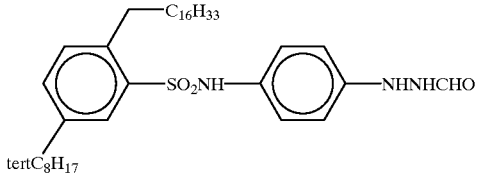

Hydrazine Derivative H-5

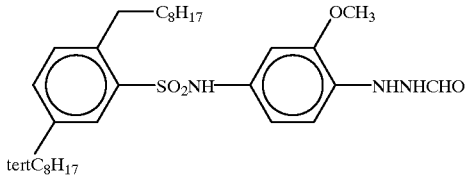

Hydrazine Derivative H-6

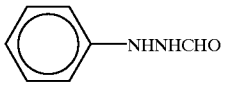

Hydrazine Derivative H-7

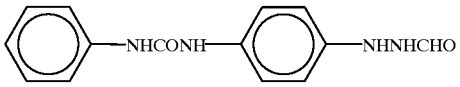

Light-Sensitive Layer 2:

Light-Sensitive Layer 2 was prepared in the same manner as Light-Sensitive Layer 1 except for using Developer-2 which is a compound fallen outside the scope of the present invention, in place of Developer-1 which is a compound fallen within the scope of the present invention.

Developer-2 (5% methanol solution)

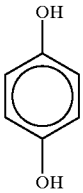

Surface Protective Layer:

The solution having the following composition was coated to have a wet thickness of 100 $\mu$m.

| | |
|---|---|
| Acetone | 175 ml |
| 2-Propanol | 40 mg |
| Methanol | 15 ml |
| Cellulose acetate | 8.0 g |
| Phthalazine | 1.0 g |
| 4-Methylphthalic acid | 0.72 g |
| Tetrachlorophthalic acid | 0.22 g |
| Tetrachlorophthalic anhydride | 0.5 g |

Sensitometry:

The heat developable light-sensitive materials prepared above each was processed into a 14×17 inch size and exposed to a laser diode of 830 nm with beams being slanted 13° from the perpendicular. Thereafter, each sample was subjected to heat development at 120° C. for 10 seconds using a heat drum.

The sensitivity was shown by a reciprocal of the exposure amount of giving a density of 0.3, the γ (gradation) was obtained as a gradient of a straight line connecting relative sensitivity points at the density of 0.1 and at the density of 3.0, and these are shown together with Dmax in Table 8.

Evaluation of Image Quality:

Using the same exposure machine as used in the sensitometry, halftone dots were generated and the image quality was evaluated. The evaluation was made by five points rating. The halftone dot quality obtained upon exposure of a scanner film LS555 produced by Fuji Photo Film Co., Ltd. using a color scanner MAGNASCAN manufactured by Fuji Photo Film Co., Ltd. was taken as Point 4. If the image quality was better, the evaluation was Point 5 and if worse, the evaluation was Point 3, 2 or 1. Those rated as Point 3 or higher lie on the practicable level as a printing light-sensitive material.

TABLE 8

| Light-Sensitive Layer | Hydrazine Derivative | Sensitivity | Dmax | γ | Image Quality | Remarks |
|---|---|---|---|---|---|---|
| 1 | none | 10 | 3.1 | γ < 5 | 2 | Comparison |
| 1 | H-1 | 49 | 4.8 | γ > 5 | 5 | Invention |
| 1 | H-2 | 42 | 4.1 | γ > 5 | 5 | " |
| 1 | H-3 | 26 | 4.6 | γ > 5 | 5 | " |
| 1 | H-4 | 25 | 4.0 | γ > 5 | 5 | " |
| 1 | H-5 | 24 | 3.9 | γ > 5 | 5 | " |
| 1 | H-6 | 23 | 3.8 | γ > 5 | 5 | " |
| 1 | H-7 | 21 | 3.6 | γ < 5 | 4 | " |
| 2 | none | fogged throughout layer | | | | Comparison |
| 2 | H-1 | fogged throughout layer | | | | Comparison |

As is seen from Table 8, the present invention provided high sensitivity and high Dmax. It is also seen that out of samples of the present invention, those having a large gradation provided good image quality. Further, it is verified that only those using a developer fallen within the scope of the present invention provided good image quality.

EXAMPLE 2

Coating on Light-Sensitive Surface Side:

Light-Sensitive Layer:

A solution for the light-sensitive layer was prepared and coated as in Example 1 except that the sensitizing dye was charged to Sensitizing Dye-2 (0.1% DMF solution) shown below and 2 ml of a hydrazine derivative (1% methanol/DMF 4:1 solution) was added as shown in Table 9. The chemical structures of Hydrazine Derivatives H-1 to H-7 are the same as those shown in Example 1.

Sensitizing Dye-2

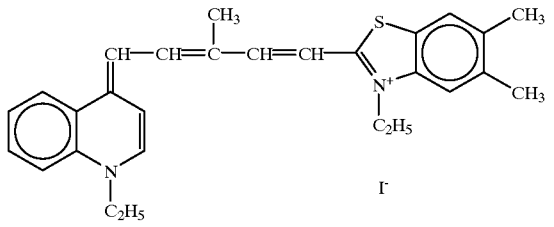

Surface Protective Layer:

The coating was performed in the same manner as in Example 1.

Coating on Back Surface Side:

The coating was performed in the same manner as in Example 1.

Sensitometry:

The heat developable light-sensitive materials prepared above each was exposed to a laser diode of 780 nm.

Other procedures were performed in the same manner as in Example 1.

Evaluation of Image Quality:

The heat developable light-sensitive materials prepared above each was exposed to a laser diode of 780 nm.

Other procedures were performed in the same manner as in Example 1.

TABLE 9

| Light-Sensitive Layer | Hydrazine Derivative | Sensitivity | Dmax | γ | Image Quality | Remarks |
|---|---|---|---|---|---|---|
| 1 | none | 10 | 3.2 | γ < 5 | 2 | Comparison |
| 1 | H-1 | 47 | 4.7 | γ > 5 | 5 | Invention |
| 1 | H-2 | 41 | 4.1 | γ > 5 | 5 | " |
| 1 | H-3 | 27 | 4.5 | γ > 5 | 5 | " |
| 1 | H-4 | 25 | 4.1 | γ > 5 | 5 | " |
| 1 | H-5 | 25 | 3.8 | γ > 5 | 5 | " |
| 1 | H-6 | 22 | 3.8 | γ > 5 | 5 | " |
| 1 | H-7 | 21 | 3.6 | γ < 5 | 4 | " |

As seen from Table 9, the present invention provided high sensitivity and high Dmax. Further, it is seen that out of samples of the present invention, those having a large gradation provided good image quality.

EXAMPLE 3

Preparation of Silver Halide Grain B:

Into 900 ml of water, 7.5 g of inert gelatin and 10 mg of potassium bromide was dissolved and after adjusting the temperature to 35° C. and the pH to 3.0, 370 ml of an aqueous solution containing 74 g of silver nitrate and an aqueous solution containing potassium bromide and potassium iodide at a molar ratio of 96/4 were added while keeping the pAg at 7.7 by a controlled double jet method over 10 minutes. At the same time with the starting of addition of silver nitrate, hexacyanoferrate(III) and hexachloroiridium(III) complex salt were added each in an amount of $1\times10^{-5}$ mol/mol-Ag. Thereafter, 0.3 g of 4-hydroxy-6-methyl-1,3,3a,7-tetrazaindene was added and the pH was adjusted to 5 with sodium hydroxide to obtain cubic silver iodobromide grains having an average grain size of 0.06 μm, a coefficient of variation in the projected area diameter of 8% and a {100} face ratio of 87%. The resulting gelatin was subjected to desalting by coagulating sedimentation using a gelatin flocculant, 0.1 g of phenoxyethanol was added thereto, and the pH and the pAg were adjusted to 5.9 and 7.5, respectively.

Preparation of Organic Fatty Acid Silver Emulsion B:

Into 300 ml of water, 10.6 g of behenic acid was poured and dissolved by heating at 90° C., 31.1 ml of 1N sodium hydroxide was added thereto under well stirring, and the mixture was allowed to stand as it was for one hour. Then, the solution was cooled to 30° C., 7.0 ml of 1N phosphoric acid was added and 0.13 g of N-bromosuccinic acid imide was added thereto under well stirring. Thereafter, Silver Halide Grain B previously prepared was added under heating at 40° C. while stirring to give a silver amount to the behenic acid of 10 mol %. Further, 25 ml of 1N aqueous silver nitrate solution was continuously added over 2 minutes and the mixture was allowed to stand while stirring as it was.

To the resulting aqueous mixture under stirring, 37 g of a 1.2 wt % n-butyl acetate solution of polyvinyl acetate was gradually added and after formation of a flock of dispersions, water was removed and the residue was subjected further to water washing and removal of water twice. Then, 20 g of a 1:2 mixed solution of a 2.5 wt % butyl acetate of polyvinyl butyral (average molecular weight: 3,000) and isopropyl alcohol was added while stirring. To the thus-obtained gelled mixture of silver behenate and silver halide, 12.5 g of polyvinyl butyral (average molecular weight: 4,000) and 57 g of isopropyl alcohol were added and dispersed.

The following layers were coated on a heat-treated polyethylene terephthalate support in sequence to prepare a sample. The drying was performed at 75° C. for 5 minutes in each step.

Coating on Back Surface Side:

A solution having the following composition was coated on the surface opposite to the surface where a light-sensitive layer is provided, to give a wet thickness of 100 μm.

| | |
|---|---|
| Polyvinyl butyral #4000-2 (produced by Denki Kagaku Kogyo KK) (10% isopropanol solution) | 60 g |
| Isopropyl alcohol | 10 g |
| Ethyl acetate 8% solution of 3-isocyanatomethyl-3,5,5-trimethylcyclohexylisocyanate (produced by Wako Junyaku KK) | 8 g |

To the resulting solution, Dye S-1 was added (a solution obtained by dissolving 0.2 g of Dye S-1 into a mixed solvent of methanol (10 g) and acetone (20 g) was added such that the absorption at the exposure wavelength of the back layer became 0.8).

Dye S-1

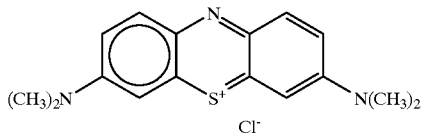

Coating on Light-Sensitive Layer Side

Light-Sensitive Layer B:

A light-sensitive layer was provided by coating a solution having the following composition on a surface opposite to the back layer to give a coated silver amount of 1.5 g/m$^2$. By varying the hydrazine derivative as shown in Table 10, various samples shown in Table 10 were prepared.

| | |
|---|---|
| Organic Fatty Acid Silver Salt Emulsion B | 73 g |
| Sensitizer D-1 (0.05% methanol solution) | 4 ml |
| Phthalazine (5% methanol solution) | 2.5 ml |
| Antifoggant-1 (1.7% DMF solution) | 2.5 ml |
| Developer-1 (10% acetone solution) | 13 ml |
| Hydrazine derivative shown in Table 10 (1% methanol solution) | 2 ml |
| 2-Mercapto-5-methylbenzotriazole (0.5% DMF solution) | 5 ml |
| $CaBr_2$ (0.3% methanol solution) | 6.5 ml |

Sensitizing Dye D-1

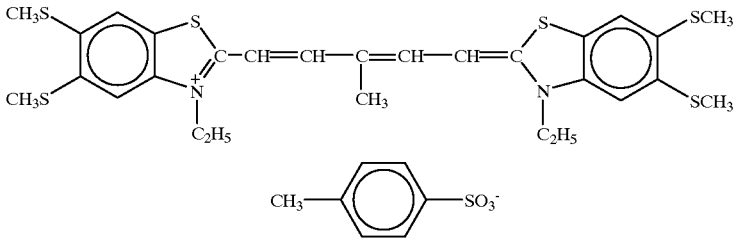

Antifoggant-1

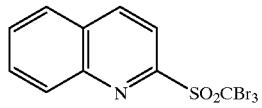

Developer-1

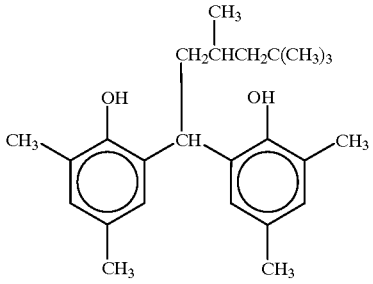

Light-Sensitive Layer C:

Light-Sensitive Layer C was provided in the same manner as Light-Sensitive Layer B except for changing Developer-1 of Light-Sensitive Layer B to Developer-2 out of the scope of the present invention.

Developer-2 hydroquinone (5% methanol solution)

Surface Protective Layer:

A solution having the following composition was coated on the light-sensitive layer to have a wet thickness of 100 μm.

| | |
|---|---|
| Acetone | 175 ml |
| Methanol | 15 ml |
| Cellulose acetate | 8.0 g |
| 4-Methylphthalic acid | 0.72 g |
| Tetrachlorophthalic acid | 0.22 g |
| Tetrachlorophthalic anhydride | 0.5 g |

Sensitometry:

Each of the heat-developable light-sensitive materials prepared above was exposed to a xenon flash light for a light emission time of $10^{-3}$ second through an interference filter having a peak at 670 nm, and then heat developed at 115° C. for 15 seconds using a heat drum.

The sensitivity is shown by a relative sensitivity to the sensitivity which is a reciprocal of the exposure amount necessary for giving a density of 3.0. The gradient of a straight line drawn by connecting the points for the density 0.1 and the density 1.5 on the characteristic curve is shown as a gradation (γ) which reveals sharpness at the foot part. The dye in the back layer was decolored by irradiating a halogen lamp for 15 seconds after heat development.

TABLE 10

| Light-Sensitive Layer | Hydrazine Derivative | Sensitivity | Dmax | γ | Remarks |
|---|---|---|---|---|---|
| C | none | | entirely fogged | | Comparison |
| C | H-1 | | entirely fogged | | Comparison |
| B | none | 10 | 3.0 | 3 | Comparison |
| B | H-1 | 42 | 3.9 | 15 | Invention |
| B | I-1 | 47 | 4.1 | 16 | Invention |
| B | I-4 | 45 | 4.0 | 17 | Invention |
| B | I-7 | 47 | 4.3 | 17 | Invention |
| B | I-8 | 49 | 4.3 | 17 | Invention |
| B | I-18 | 44 | 4.2 | 16 | Invention |
| B | I-20 | 43 | 4.1 | 16 | Invention |
| B | I-22 | 44 | 4.0 | 16 | Invention |
| B | I-23 | 45 | 4.2 | 17 | Invention |
| B | I-24 | 47 | 4.2 | 16 | Invention |
| B | I-25 | 45 | 4.3 | 17 | Invention |
| B | I-26 | 48 | 4.2 | 17 | Invention |
| B | I-27 | 47 | 4.3 | 17 | Invention |
| B | I-28 | 48 | 4.2 | 17 | Invention |
| B | I-30 | 45 | 4.3 | 16 | Invention |
| B | I-31 | 44 | 4.2 | 16 | Invention |
| B | I-32 | 44 | 4.1 | 16 | Invention |
| B | I-33 | 47 | 4.2 | 17 | Invention |
| B | I-34 | 43 | 4.1 | 16 | Invention |
| B | I-35 | 44 | 4.5 | 18 | Invention |
| B | I-36 | 46 | 4.3 | 17 | Invention |
| B | I-38 | 49 | 4.5 | 16 | Invention |
| B | I-41 | 50 | 4.4 | 18 | Invention |
| B | I-42 | 49 | 4.5 | 19 | Invention |
| B | I-43 | 52 | 4.5 | 18 | Invention |
| B | I-44 | 50 | 4.6 | 18 | Invention |
| B | I-45 | 51 | 4.5 | 18 | Invention |
| B | I-46 | 52 | 4.4 | 19 | Invention |
| B | I-50 | 53 | 4.6 | 18 | Invention |
| B | I-55 | 51 | 4.5 | 18 | Invention |
| B | I-57 | 55 | 4.5 | 18 | Invention |
| B | I-62 | 53 | 4.4 | 18 | Invention |
| B | I-66 | 52 | 4.3 | 18 | Invention |
| B | I-69 | 51 | 4.4 | 19 | Invention |
| B | I-70 | 50 | 4.5 | 18 | Invention |
| B | I-72 | 51 | 4.3 | 18 | Invention |
| B | I-73 | 52 | 4.3 | 18 | Invention |
| B | I-74 | 53 | 4.4 | 19 | Invention |
| B | I-75 | 51 | 4.4 | 18 | Invention |
| B | I-76 | 55 | 4.4 | 18 | Invention |
| B | I-78 | 53 | 4.5 | 18 | Invention |
| B | I-79 | 52 | 4.4 | 19 | Invention |
| B | I-80 | 53 | 4.5 | 18 | Invention |
| B | I-82 | 51 | 4.3 | 18 | Invention |
| B | I-83 | 55 | 4.4 | 18 | Invention |
| B | I-84 | 55 | 4.4 | 18 | Invention |

Hydrazine Derivative H-1

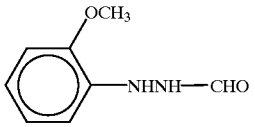

As seen from Table 10, samples of the present invention exhibited both high sensitivity and high γ value.

EXAMPLE 4

The following layers were coated in sequence on a heat-treated polyethylene terephthalate support to prepare a sample. Drying was conducted at 75° C. for 5 minutes in each step.

Coating on back surface:

A coating solution having the same formulation as the back layer in Example 3 was coated in the same manner.

Coating on light-sensitive layer surface:

Light-Sensitive Layer D

A solution having the following composition was coated on the surface opposite to the back layer to give a coated silver amount of 1.5 g/m$^2$ to provide a light-sensitive layer. The developer was varied as shown in Table 11 and various samples shown in Table 11 were prepared.

| | |
|---|---|
| Organic Fatty Acid Silver Salt Emulsion B | 73 g |
| Sensitizing Dye D-1 (0.05% methanol solution) | 4 ml |
| Phthalazine (5% methanol solution) | 2.5 ml |
| Antifoggant-1 (1.7% DMF solution) | 2.5 ml |
| Developer (shown in Table 11) (10% acetone solution) | 13 ml |
| Hydrazine derivative (shown in Table 11) (1% methanol solution) | 2 ml |
| 2-Mercapto-5-methylbenzotriazole (0.5% DMF solution) | 5 ml |
| $CaBr_2$ (0.3% methanol solution) | 6.5 ml |

Surface Protective Layer:

A coating solution having the same formulation as the surface protective layer in Example 3 was coated in the same manner.

Sensitometry

Each of the heat developable light-sensitive materials prepared above was exposed to a xenon flash light for a light emission time of $10^{-3}$ second through an interference filter having a peak at 670 nm, and then heat developed at 115° C. for 15 seconds using a heat drum.

The sensitivity is shown by a relative sensitivity to the sensitivity which is a reciprocal of the exposure amount necessary for giving a density of 3.0. Further, the gradient of a straight line drawn by connecting the points for density 0.1 and density 1.5 on the characteristic curve is shown as a gradation (γ) which reveals sharpness of the foot part. The dye in the back layer was decolorized by irradiating a halogen lamp for 15 seconds after heat development.

TABLE 11

| Hydrazine Derivative | Developer | Sensitivity | Dmax | γ | Remarks |
|---|---|---|---|---|---|
| none | G-2 | | entirely fogged | | Comparison |
| H-1 | G-2 | | entirely fogged | | Comparison |
| none | G-1 | 10 | 2.8 | 3 | Comparison |
| H-1 | G-1 | 43 | 4.1 | 15 | Comparison |
| none | R-I-36 | 11 | 2.9 | 3 | Comparison |
| H-1 | R-I-36 | 42 | 4.5 | 18 | Invention |
| none | R-III-1 | 12 | 3.1 | 3 | Comparison |
| H-1 | R-III-1 | 45 | 4.7 | 18 | Invention |
| none | R-III-8 | 12 | 3.0 | 3 | Comparison |
| H-1 | R-III-8 | 49 | 4.6 | 18 | Invention |
| none | R-II-10 | 12 | 3.2 | 3 | Comparison |
| H-1 | R-II-10 | 43 | 4.7 | 19 | Invention |

Hydrazine Derivative H-1

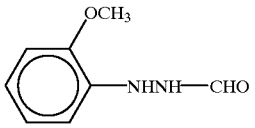

As is seen from Table 11, samples of the present invention exhibited both high sensitivity and high γ value.

While the invention has been described in detail and with reference to specific examples thereof, it will be apparent to one skilled in the art that various changes and modifications can be made therein without departing from the spirit and scope thereof.

What is claimed is:

1. A heat developable light-sensitive material comprising an organic acid silver and silver halide, which contains:

a compound represented by the following formula (A):

(A)

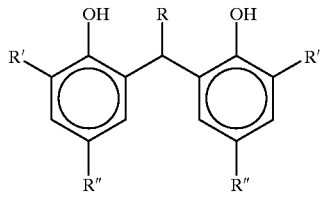

wherein R represents a hydrogen atom or an alkyl group having from 1 to 10 carbon atoms and R' and R" each represents an alkyl group having from 1 to 5 carbon atoms; and a hydrazine derivative represented by the following formula (II), (III), (IV) or (V):

(II)

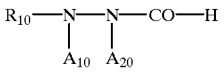

(III)

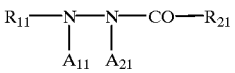

(IV)

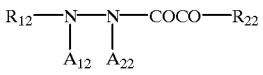

(V)

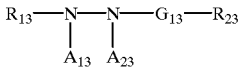

wherein $R_{10}$ is a heterocyclic group, $R_{11}$ to $R_{13}$ each represents an aromatic group or an unsaturated heterocyclic group, $A_{10}$ to $A_{13}$, $A_{20}$ to $A_{23}$ each represent a hydrogen atom, or $A_{10}$ to $A_{13}$ represent a hydrogen atom and $A_{20}$ to $A_{23}$ represents a substituted or unsubstituted alkylsulfonyl group, a substituted or unsubstituted arylsulfonyl group or a substituted or unsubstituted acyl group;

in formula (III), $R_{21}$ represents an alkyl group substituted by at least one electron-withdrawing group, an aryl group substituted by at least one electron-withdrawing group, a heterocyclic group, an amino group, an alkylamino group, an arylamino group, a heterocyclic amino group, a hydrazino group, an alkoxy group or an aryloxy group;

in formula (IV), $R_{22}$ represents an amino group, an alkylamino group, an arylamino group, a heterocyclic amino group, a hydrazino group, an alkoxy group, an aryloxy group, an alkyl group or an aryl group;

in formula (V), $G_{13}$ represents an —$SO_2$— group, an —SO— group, a

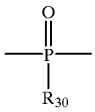

group (wherein $R_{30}$ represents a hydrogen atom, an alkyl group, an aryl group, an unsaturated heterocyclic group, an alkoxy group, an aryloxy group, an amino group or a hydrazino group), a thiocarbonyl group or an iminomethylene group, and $R_{23}$ represents an alkyl group, an aryl group, an alkoxy group, an aryloxy group, an amino group, an alkylamino group, an arylamino group, a heterocyclic amino group or a hydrazino group.

2. A heat developable light-sensitive material as claimed in claim 1, wherein the gradation γ after heat development satisfies γ>5.

3. A heat developable light-sensitive material as claimed in claim 1, wherein said hydrazine derivative is present in an amount of from $1\times10^{-6}$ to $1\times10^{-1}$ mol/mol-Ag.

4. A heat developable light-sensitive material as claimed in claim 1, wherein said hydrazine derivative is present in an amount of from $1\times10^{-5}$ to $5\times10^{-2}$ mol/mol-Ag.

5. A heat developable light-sensitive material as claimed in claim 1, which further comprises a nucleation accelerator in an amount of $2\times10^{-5}$ to $1\times10^{-2}$ mol/mol-Ag.

6. A heat developable material as claimed in claim 1, wherein the compound represented by formula (A) is present in an amount of from $1\times10^{-2}$ to 1.5 mol/mol-Ag.

7. A heat developable light-sensitive material comprising an organic acid silver and silver halide, which contains a compound represented by formula (R-I), (R-II), (R-III) or (R-IV) and a hydrazine derivative represented by formula (II), (III), (IV) or (V):

(R-I)

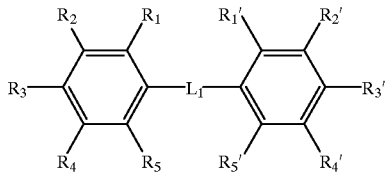

(R-II)

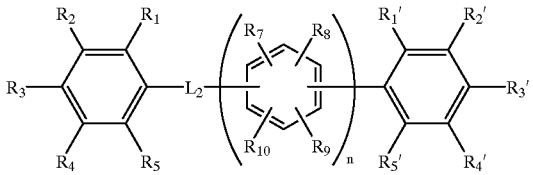

(R-III)

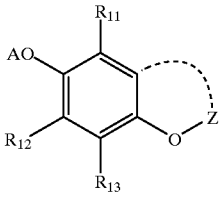

-continued (R-IV)

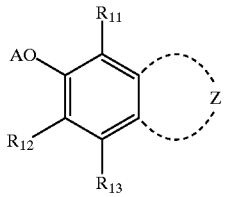

wherein in formula (R-III), the ring structure formed by Z is represented by the following formula (Z-1) or (Z-2):

(Z-1)

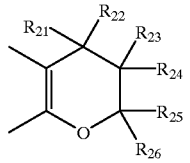

(Z-2)

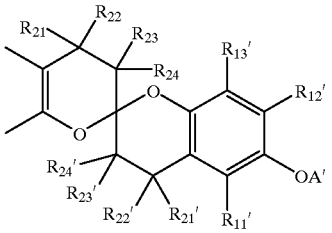

in formula (R-IV) ,the ring structure formed by Z is represented by the following formula (Z-3) or (Z-4):

(Z-3)

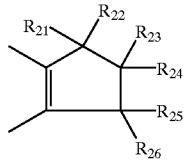

(Z-4)

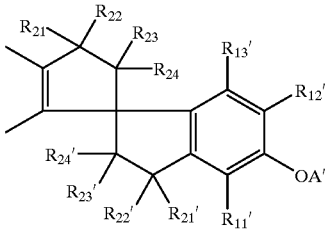

wherein $L_1$ represents a sulfur atom and $L_2$ represents a group represented by $>CH(R_6)$ or a sulfur atom, and n represents a natural number; in the formulae, $R_1$ to $R_{10}$, $R_1'$ to $R_5'$, $R_{11}$ to $R_{13}$, $R_{11}'$ to $R_{13}'$, $R_{21}$ to $R_{26}'$, and $R_{21}'$ to $R_{24}'$ each represents a hydrogen atom, an alkyl group, an aryl group, an aralkyl group, a halogen atom, an amino group or a group represented by —OA, provided that at least one of $R_1$ to $R_5$ is a group represented by —OA, at least one of $R_1'$ to $R_5'$ is a group represented by —OA, and at least one of $R_7$ to $R_{10}$ is a group represented by —OA, and a plurality of substituents in each cluster of $R_1$ to $R_{10}'$, $R_1'$ to $R_5'$, $R_{11}$ to $R_{13}$, $R_{11}'$ to $R_{13}'$, $R_{21}$ to $R_{26}$, and $R_{21}'$ to $R_{24}'$ may be combined with each other to form a ring;

A and A' each represents a hydrogen atom, an alkyl gorup, an acyl group, an aryl group, a phosphoric acid group or a sulfonyl group; and $R_1$ to $R_{10}$, $R_1'$ to $R_5'$, $R_{11}$ to $R_{13}$, $R_{11}'$ to $R_{13}'$, $R_{21}$ to $R_{26}'$, and $R_{21}'$ to $R_{24}'$, A and A' each may be substituted;

(II)

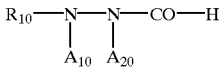

(III)

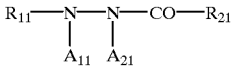

(IV)

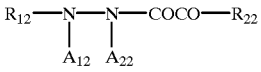

(V)

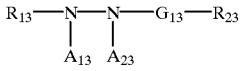

wherein $R_{10}$ is a heterocyclic group, $R_{11}$ to $R_{13}$ each represents an aromatic group or an unsaturated heterocyclic group, $A_{10}$ to $A_{13}$, $A_{20}$ to $A_{23}$ each represent a hydrogen atom, or $A_{10}$ to $A_{13}$ represent a hydrogen atom and $A_{20}$ to $A_{23}$ represents a substituted or unsubstituted alkylsulfonyl group, a substituted or unsubstituted arylsulfonyl group or a substituted or unsubstituted acyl group;

in formula (III), $R_{21}$ represents an alkyl group substituted by at least one electron-withdrawing group, an aryl group substituted by at least one electron-withdrawing group, a heterocyclic group, an amino group, an alkylamino group, an arylamino group, a heterocyclic amino group, a hydrazino group, an alkoxy group or an aryloxy group;

in formula (IV), $R_{22}$ represents an amino group, an alkylamino group, an arylamino group, a heterocyclic amino group, a hydrazino group, an alkoxy group, an aryloxy group, an alkyl group or an aryl group;

in formula (V), $G_{13}$ represents an $—SO_2—$ group, an —SO— group, a

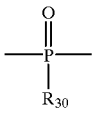

group (wherein $R_{30}$ represents a hydrogen atom, an alkyl group, an aryl group, an unsaturated heterocyclic group, an alkoxy group, an aryloxy group, an amino group or a hydrazino group), a thiocarbonyl group or an iminomethylene group, and $R_{23}$ represents an alkyl group, an aryl group, an alkoxy group, an aryloxy group, an amino group, an alkylamino group, an arylamino group, a heterocyclic amino group or a hydrazino group.

8. A heat developable light-sensitive material as claimed in claim 7, wherein the gradation γ after heat development satisfies γ>5.

9. A heat developable light-sensitive material as claimed in claim 7, wherein said hydrazine derivative is present in an amount of from $1\times10^{-6}$ to $1\times10^{-1}$ mol/mol-Ag.

10. A heat developable light-sensitive material as claimed in claim 7, wherein said hydrazine derivative is present in an amount of from $1\times10^{-5}$ to $5\times10^{-2}$ mol/mol-Ag.

11. A heat developable light-sensitive material as claimed in claim 7, which further comprises a nucleation accelerator in an amount of $2\times10^{-5}$ to $1\times10^{-2}$ mol/mol-Ag.

12. A heat developable light-sensitive material as claimed in claim 7, wherein the compounds represented by (R-I), (R-II), (R-III), or (R-IV) are present in an amount of from $1\times10^{-3}$ to 10 mol/mol-Ag.

13. A heat developable light-sensitive material as claimed in claim 7, wherein the compounds represented by (R-I), (R-II), (R-III), or (R-IV) are present in an amount of from $1\times10^{-2}$ to 1.5 mol/mol-Ag.

14. A heat developable light sensitive material as claimed in claim 7, wherein at least one of (R-I) to (R-IV) is present.

* * * * *